US007852331B2

(12) United States Patent
Garverick et al.

(10) Patent No.: US 7,852,331 B2
(45) Date of Patent: Dec. 14, 2010

(54) HIGH-VOLTAGE TERNARY DRIVER USING DYNAMIC GROUND

(75) Inventors: Steven L. Garverick, Solon, OH (US); Ruchi Kothari, Cleveland Hts, OH (US)

(73) Assignee: Case Western Reserve University, Cleveland, OH (US)

( * ) Notice: Subject to any disclaimer, the term of this patent is extended or adjusted under 35 U.S.C. 154(b) by 1027 days.

(21) Appl. No.: 11/559,500

(22) Filed: Nov. 14, 2006

(65) Prior Publication Data

US 2007/0109285 A1 May 17, 2007

Related U.S. Application Data

(60) Provisional application No. 60/736,446, filed on Nov. 14, 2005.

(51) Int. Cl.
*G09G 5/00* (2006.01)

(52) U.S. Cl. ..... 345/211

(58) Field of Classification Search ..... 345/89, 345/204, 211–214, 690; 73/514.18
See application file for complete search history.

(56) References Cited

U.S. PATENT DOCUMENTS

2003/0140698 A1* 7/2003 Garverick et al. ..... 73/514.18
2005/0206635 A1* 9/2005 Hashimoto ..... 345/204

* cited by examiner

*Primary Examiner*—Amare Mengistu
*Assistant Examiner*—Rodney Amadiz
(74) *Attorney, Agent, or Firm*—Tarolli, Sundheim, Covell & Tummino LLP

(57) ABSTRACT

Systems and methods for implementing a ternary driver that provides three voltage levels: a high positive voltage, a high negative voltage and a zero voltage. The ternary driver utilizes a dynamic ground to maintain the mid-level zero voltage level at approximately zero volts allowing for voltage regulation during high voltage scenarios. The dynamic ground can be activated when the measured voltage is outside user defined reference voltage levels.

16 Claims, 22 Drawing Sheets

900

HIGH-VOLTAGE TERNARY DRIVER USING DYNAMIC GROUND

CROSS REFERENCE TO RELATED APPLICATION(S)

This application claims the benefit of U.S. Provisional Patent Application Ser. No. 60/736,446 filed on Nov. 14, 2005, entitled "HIGH-VOLTAGE TERNARY DRIVER USING DYNAMIC GROUND." The entirety of which application is incorporated herein by reference.

TECHNICAL FIELD

The subject innovation relates to ternary drivers and, more particularly, to ternary drivers with a dynamic ground within an LCD panel display and/or MEMS system.

BACKGROUND

Recent advancements in flexible liquid crystal display (LCD) technology have led to improved screen resolution, longevity and higher performance. The technologies related to LCD displays are still emerging and evolving. In contrast to cathode ray tubes (CRTs) that can actively generate light by exciting phosphor molecules, an LCD can receive white light (e.g., from the display background) and filters such white light to produce the various shades of gray and/or colors. To obtain colors, for instance, each pixel can include three sub pixels utilizing lights of various colors (e.g., red, green and blue light) that can be excited and/or energized to emanate respective colors. When the sub pixel is off, the filter can block the specified color of light, in contrast, the open filter allows a desired amount of light and/or color through when the sub-pixel is on. In general, a majority of LCD displays utilize either high ambient light levels or bright backlighting since liquid crystals do not generate light, but rather only block light.

The term "pixel" is actually an abbreviated version of the term "picture element." Each pixel can display one color and/or one shade of gray. However, since pixels are extremely small, blending often occurs that forms various shades and/or blends of colors and/or grays. The number of colors each pixel represents can be determined by the amount of bits utilized therewith. For example, 8-bit color allows for 2 to the $8^{th}$ power, or 256 colors to be displayed. At this color depth, "graininess" can occur wherein one color does not appear to blend into another. However, at 16, 24, and 32-bit color depths, the color is well blended, permitting human perception of the screen image.

A critical component of flexible LCD technology is the drive electronics, wherein such circuits energize the LCD and influence such factors as the number of available colors, shades of gray, power consumption, heat generation, video noise, etc. Conventionally, the designs of the commercial parts provide binary or analog output levels. Binary drivers can utilize positive high voltage and electronic ground in operation. In a binary drive scheme for a LCD display panel, rows and columns are driven out-of-phase using waveforms that switch between ground and the high-voltage (HV). An un-driven column is held at approximately zero (0) volts while undriven rows are held at approximate zero (0) volts or are disconnected (allowed to "float"). A fully energized pixel receives an AC voltage with amplitude HV, while a half energized pixel receives an AC voltage with an amplitude of up to HV/2 that is superimposed on a bias voltage. By adjusting the HV amplitude so HV/2 is below the electrooptical threshold of the liquid crystal it will not be activated by this half-amplitude AC, but the DC bias results in excessive power dissipation. Also, a binary driver operating at high voltage can often damage a system because the average DC voltage "seen" by the device can be HV/2, which many devices can not tolerate. If the undriven columns are disconnected (allowed to "float") the AC voltage received by the half energized pixels would depend on the activation pattern and for worst case pattern be HV which equals the AC voltage for energized pixels. This would result in unwanted activation of pixels.

SUMMARY

The following presents a simplified summary in order to provide a basic understanding of some aspects of the claimed subject matter. This summary is not an extensive overview. It is not intended to identify key/critical elements or to delineate the scope of the claimed subject matter. Its sole purpose is to present selected concepts, in a simplified form, as a prelude to the more detailed description that is presented later.

The subject innovation relates to systems and/or methods that facilitate utilizing a high-voltage ternary driver, which implements a dynamic ground for an LCD display panel and/or MEMS. The ternary driver provides three discrete output levels-positive high voltage, ground and negative high voltage. For instance, the dynamic ground circuit can further include a Schmitt Trigger. A Schmitt Trigger can be a comparative circuit that changes an associated output condition and/or state when the input voltage rises above a reference voltage. Furthermore, the output condition or state associated with the circuit may not automatically turn on when the input voltage drops unless the voltage falls below a second lower reference voltage. The Schmitt Trigger can guard against and prevent noise, wherein such noise can cause rapid switching back and forth between the two output conditions or states.

In one example, a Schmitt Trigger can operate at ±5 V, detecting ±22 mV deviations from ground voltage. Such detection can be implemented to activate high-voltage push and/or pull transistors that dynamically maintain ground (approximately 0 volts) in the circuit. At least one level translator can provide a gate drive for the push and/or pull transistors without consuming DC power from, for example, the high voltage supplies. The design of such circuits can utilize little or no off-chip components or references other than a single large resistor per channel. Such designs can allow the voltage divider used by the Schmitt Trigger, and one large resistor per integrated circuit (IC), to be used to set the reference levels for the push and/or pull gate drive.

Ternary drivers can provide significant payback in LCD display panels and/or MEMS concerning reduced power consumption, lower heat generation and greater selectivity (e.g., the ability to write and/or erase a given pixel without affecting adjacent pixels and/or avoiding DC voltage component). In another example, high-voltage analog amplifiers can be used to implement the ternary scheme, but may utilize higher power consumption than an optimized ternary driver.

Appendix A is an article that further details various aspects of the subject innovation, and this appendix is to be considered part of the detailed description of this application.

Appendix B is a collection of illustrations/examples in connection with particular aspects of the innovation, and this appendix is to be considered part of the detailed description of the application.

Appendix C is an article further detailing particular aspects of the claimed subject matter, and this appendix is to be considered part of the detailed description of the application.

Appendix D is a compilation of drawings and illustrations associated with various aspects of the claimed subject matter, and this appendix is to be considered part of the detailed description of the application.

Appendix E is an article that further details various aspects of the subject innovation, and this appendix is to be considered part of the detailed description of the application.

Appendix F is an article further detailing particular aspects of the claimed subject matter, and this appendix is to be considered part of the detailed description of the application.

Appendix G is an article that further details various aspects of the claimed subject matter, and this appendix is to be considered part of the detailed description of the application.

Appendix H is an article that further details various aspects of the subject innovation, and this appendix is to be considered part of the detailed description of this application.

Appendix I illustrates various aspects of the subject innovation and is to be considered part of the detailed description of this application.

DETAILED DESCRIPTION

The various aspects of the subject innovation are now described with reference to the annexed block diagrams and drawings, wherein like numerals refer to like or corresponding elements throughout. It should be understood, however, that the block diagrams, drawings and detailed description relating thereto are not intended to limit the claimed subject matter to the particular form disclosed. Rather, the intention is to cover all modifications, equivalents, and alternatives falling within the spirit and scope of the claimed subject matter.

As used herein, the terms "component," "system," "driver," "panel," and the like are intended to refer to a system, method, apparatus or article of manufacture. The word "exemplary" is used herein to mean serving as an example, instance, or illustration. Any aspect or design described herein as "exemplary" is not necessarily to be construed as preferred or advantageous over other aspects or designs. Furthermore, the disclosed subject matter may be implemented as a system, method, apparatus, or article of manufacture.

Figure 1:
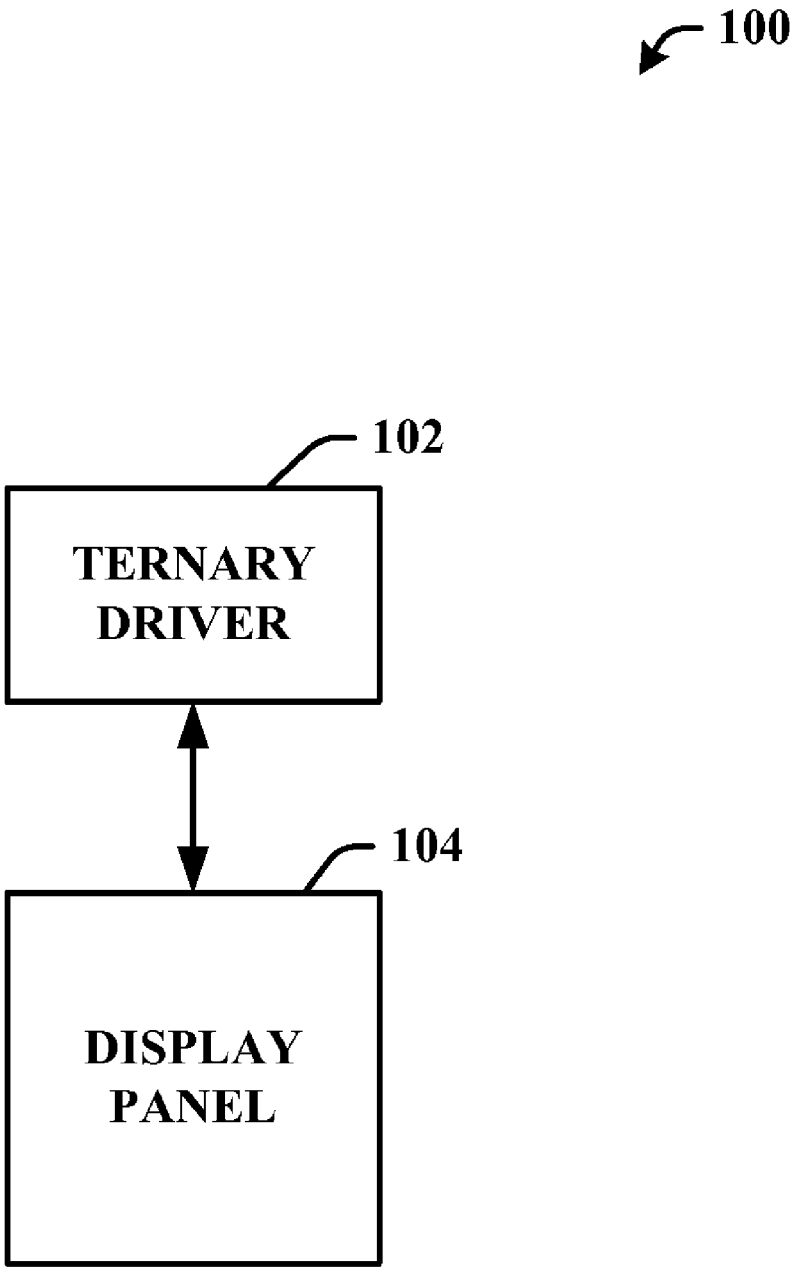
FIG. 1 illustrates a block diagram of an exemplary system that facilitates activating a display panel utilizing an electronic ternary driver.

Now turning to the figures, FIG. 1 illustrates a system 100 that facilitates energizing a liquid crystal display (LCD) by utilizing a ternary driver. The system 100 can include a ternary driver 102 that can activate at least one pixel associated with a display panel 104, wherein the display panel can be driven at high voltage levels. In one example, the display panel 104 is a thin, planar device that consists of pixels that can be color and/or monochrome, in a particular arrangement (e.g., rows and/or columns). In another example, the display panel 104 can be a liquid crystal display (LCD), a cathode ray tube (CRT), a liquid crystal on silicon (LCOS), an organic light-emitting diode (OLED), a flat panel, and/or any other suitable display device. The pixels associated with the display panel 104 can be arranged in front of a light source such that the pixels are illuminated providing images and/or viewable material to a user. It is to be appreciated and understood that pixels can be arranged in numerous ways (e.g., a circular pattern) and the display panel 104 can be contoured and/or formed in other non-linear shapes.

The ternary driver 102 can energize a plurality of pixels located in various rows and columns on the display panel 104. In one example, the ternary driver 102 energizes the rows and columns out-of-phase between the negative, high voltage (−HV/2) and the positive, high voltage (+HV/2) supplies. The un-driven row or column can be held at ground (approximately zero volts). Furthermore, there can be three types of pixels: 1) fully addressed pixels (FAP), a pixel with a driven row and a driven column; 2) half addressed pixels (HAP), a pixel with a driven row or a driven column, but not both; and 3) an unaddressed pixel (UAP), a pixel with neither a driven row or a driven column. FAPs can receive an AC voltage with an amplitude of HV, while the HAP receives an AC voltage with the amplitude of HV/2with zero DC bias. By utilizing the ternary driver 102 to activate the display panel 104, and not a simple binary driver, excessive power dissipation (which occurs in binary driver) can be minimized. It is to be appreciated that a plurality of high voltage ternary drivers 102 can be utilized to drive a plurality of pixels.

Ternary electronic systems such as the system 100 provide significant benefits over conventional binary drivers and/or systems. In particular, ternary electronics provide significant improvements in operating a display panel in regards to reduced power consumption, decreased heat generation and/or improved selectivity (e.g., the ability to write and/or erase a given pixel without affecting other pixels). Such improvements can be based at least in part upon the fact that the ternary driver 102 provides three levels of voltage: high positive voltage, high negative voltage and zero voltage. The three levels allow the ternary driver 102 to operate in a much more efficient manner. Moreover, the ternary driver 102 can be utilized along with a dynamic ground, wherein the dynamic ground maintains a mid-level voltage at a relatively stable, zero volts.

Another technology that can benefit from high voltage ternary electronics is micro-electromechanical systems (MEMS)(not shown). MEMS can be fabricated utilizing substantially similar techniques utilized to create integrated circuits. These techniques can employ micromachining processes that selectively etch away and/or layer materials to create MEMS devices. Such MEMS devices can include, for instance, miniature valves, motors, gyroscopes, actuators, mirror directors, cameras, sensors, smart products, robots, DNA delivery systems, accelerometers, probes (e.g., deep space probes, oceanographic probes, diagnostic probes, etc.). Such MEMS devices can utilize the ternary driver 102 based at least in part upon the ternary driver 102 extreme tolerance related to high voltages.

In one example, DNA delivery systems are being designed that can be referred to as "Lab on Chip." "Lab on Chip" can be a silicon chip combined with miniature fluid chambers that measure chemical properties, biological properties, and deliver fluids directly to tissues and cells. The long term goal of "Lab on Chip" technology is to create low cost, low power MEMS that can act as clinical diagnostic devices that analyze the cells and tissues and deliver needed medicines or DNA directly to those cells and tissues. DNA delivery systems are another application that can benefit from a power efficient ternary driver 102 and dynamic ground.

Figure 2:
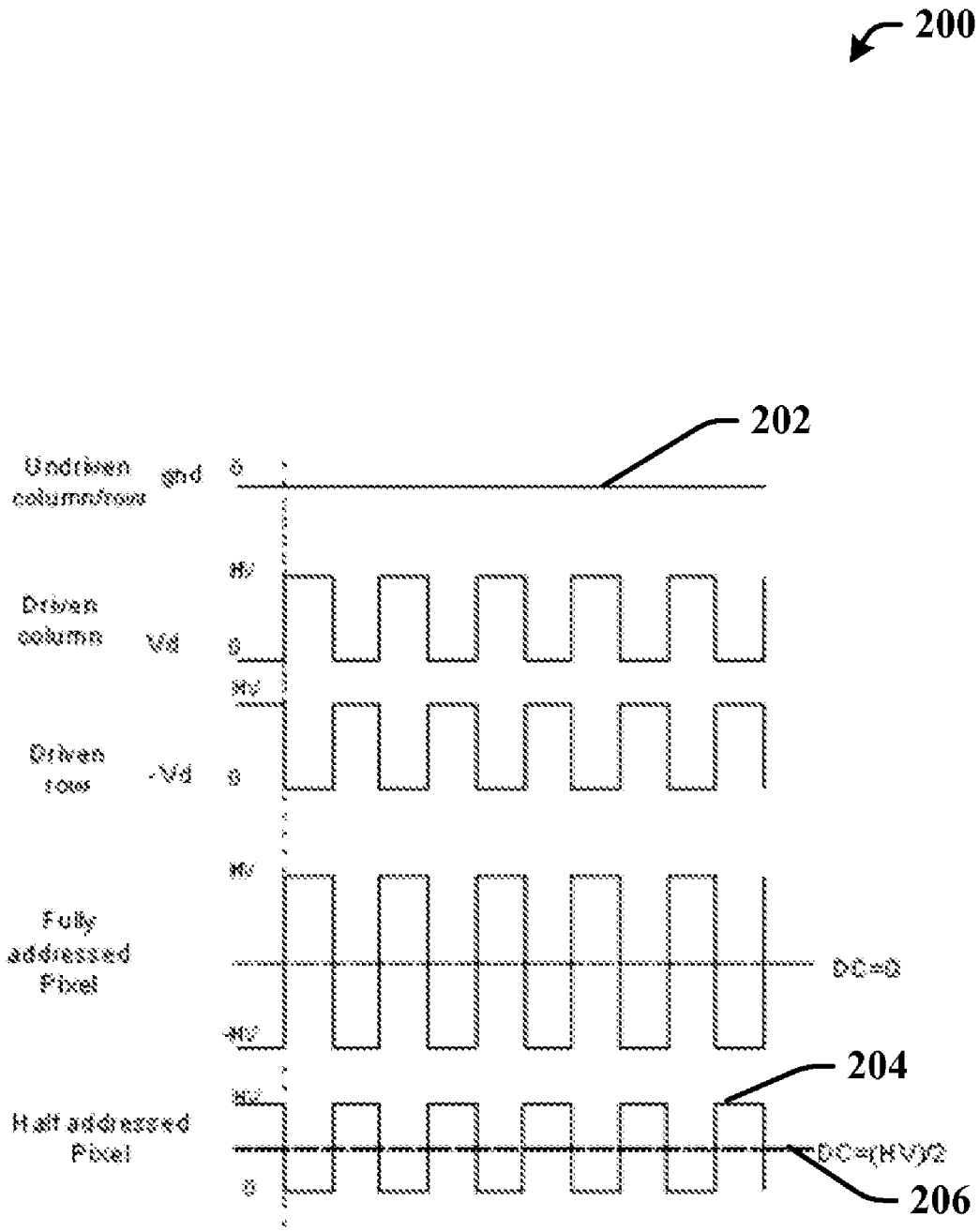
FIG. 2 illustrates a number of binary waveforms.

FIG. 2 illustrates a system 200 that generates binary waveforms. In a binary drive scheme, the rows and columns can be driven out-of-phase using waveforms that switch between a ground (0) 202 and a high-voltage supply (HV). An undriven row or column can be held at 0, as illustrated in FIG. 2. The FAP can receive an ac voltage with amplitude HV, while the HAP can receive an ac voltage with an amplitude HV/2 204 that is superimposed on a bias voltage of HV/2 206. The liquid crystal can be made to be insensitive to this half-amplitude ac, but the dc bias of HV/2 204 can result in excessive power dissipation. As discussed previously, a binary driver operating at high voltage can often damage a system because the average voltage "seen" by the device can be HV/2204, which many devices can not tolerate. Various sample(s) of binary waveforms are also illustrated on page 4 of Appendix A, "Panel Model and Ternary Drive Scheme for PolyDisplay Flexible LCD Technology". Appendix A provides illustrations/examples in connection with various aspects of the innovation, and this appendix is considered part of the detailed description of this application.

Figure 3:
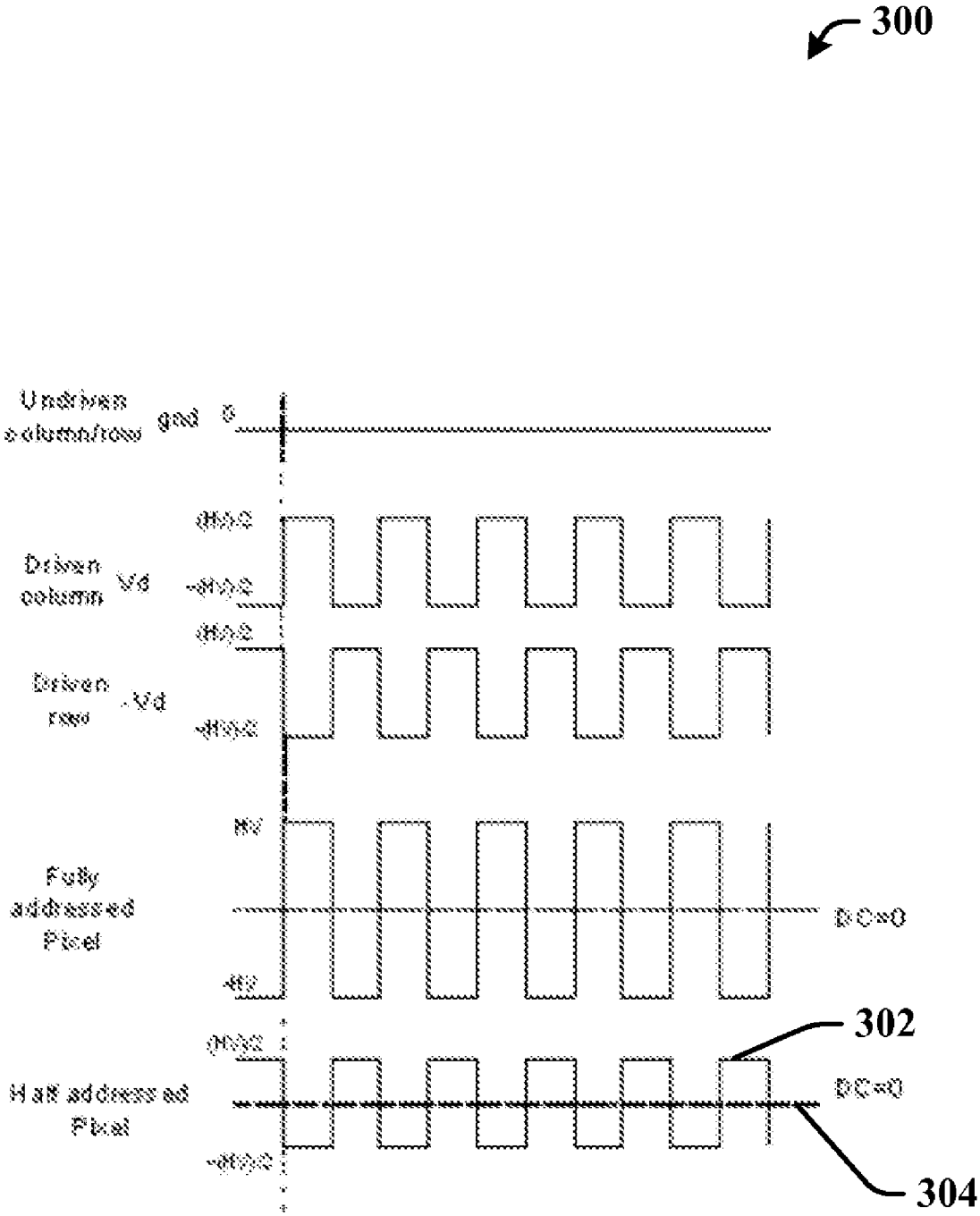
FIG. 3 illustrates a number of ternary waveforms.

FIG. 3 illustrates a ternary drive system 300 that generates ternary waveforms. The ternary drive system 300 when driven at a half amplitude of HV/2 302 can have a 0 dc bias that can protect the electrical device it is driving. In a ternary drive scheme, rows and columns can be driven out-of-phase using waveforms that switch between the negative (−HV/2) and the positive (+HV/2) 302 high-voltage supplies. An undriven row or column can be held at ground (0), as illustrated in FIG. 3. The FAP can receive an ac voltage with amplitude HV, while a HAP receives an ac voltage with amplitude HV/2 302 with 0 dc bias 304. Thus, the problem with excessive power dissipation in HAPs can be avoided, that can often be associated with binary drivers.

In one example, a MEMS can be driven using the ternary drive system. The MEMS can be driven utilizing an ac voltage of 100 volts. Over the duration of operation the average voltage seen by the device is zero volts which can result in longer life of the MEMS. Various sample(s) of ternary waveforms are also illustrated in Appendix A, "Panel Model and Ternary Drive Scheme for PolyDisplay Flexible LCD Technology".

Figure 4:
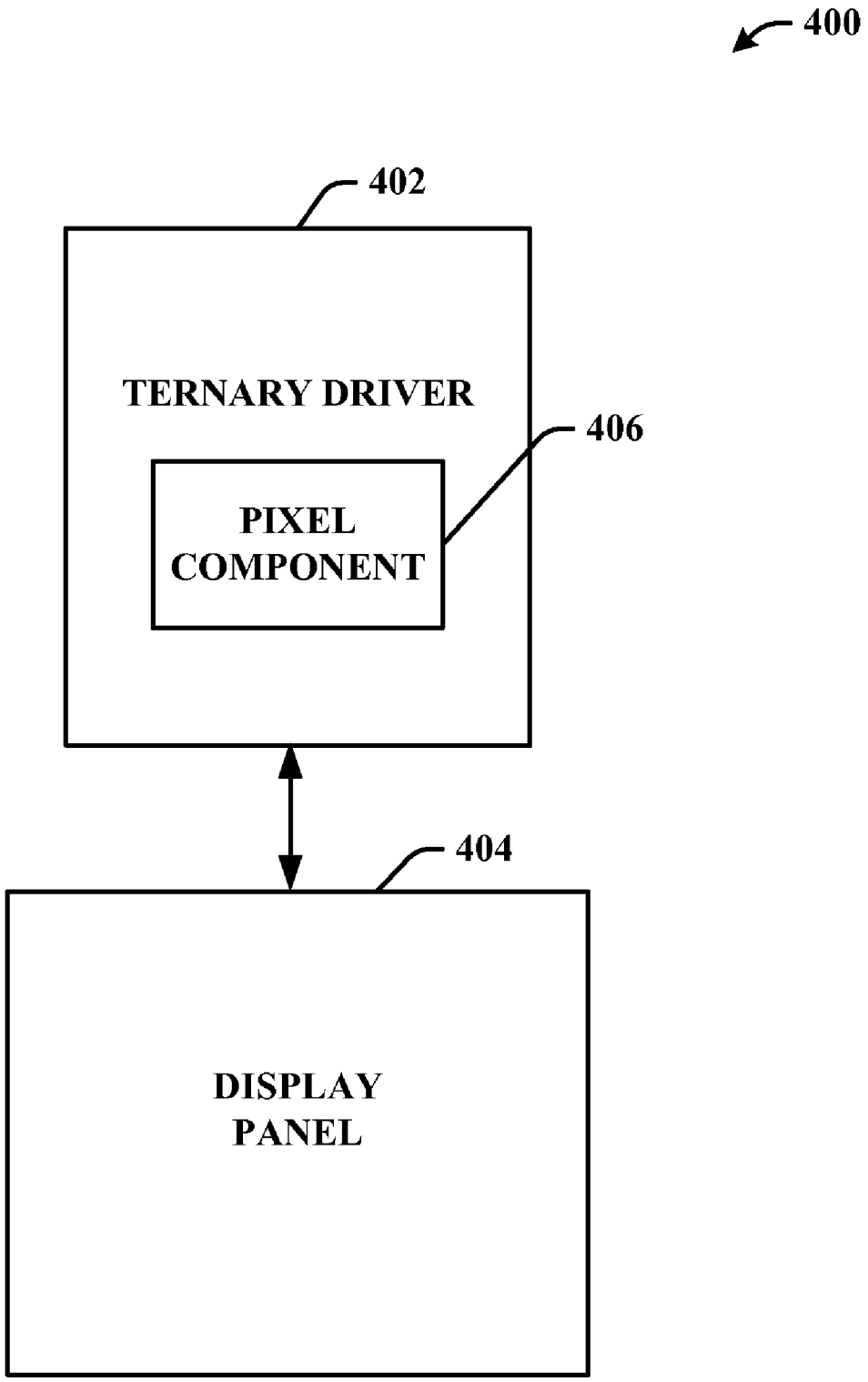
FIG. 4 illustrates a block diagram of an exemplary system that facilitates activating at least one pixel on a display panel via a ternary driver.

FIG. 4 illustrates a system 400 that facilitates activating pixels on a display panel. A ternary driver 402 can be associated with a pixel component 406, wherein the pixel component 406 can be associated with and/or excite at least one pixel within a display panel 404. The pixel component 406 can energize various pixels, based at least in part upon the particular pixel assignment, which can be monochrome and/or color. In one particular example, the pixel component 406 can energize the red, green and blue sub-pixels at a particular intensity and the mixture of the three-color intensities creates a color that the user perceives. The pixel component 406 can energize the pixel fully, partially and/or not at all to display a range of colors and/or gray, from light to dark. In one example, the display panel 404 can be 1024×768 (typical laptop resolution), which displays 1024 pixels in each row having 768 rows (lines).

The pixel component 406 energizes various pixels and sub pixels within the display panel 404 to create a visual image, wherein such visual image can be presented to a user. The number of bits of information stored per pixel of an image can drive the intensity, such that the intensities of red, green and blue sub-pixels correlate to the particular color that can be displayed. In one example, allowing 24 bits per pixel can provide 256 levels for each pixel component and over 16 million different colors, which can the human eye in unable to differentiate. It is to be appreciated that the more bits of data per pixel, the greater the resolution on the display panel 404 and the more power is needed to drive the pixel component 406, therefore the ternary driver 402 can possibly supply greater power, in a more energy efficient manner than a binary driver.

Figure 5:
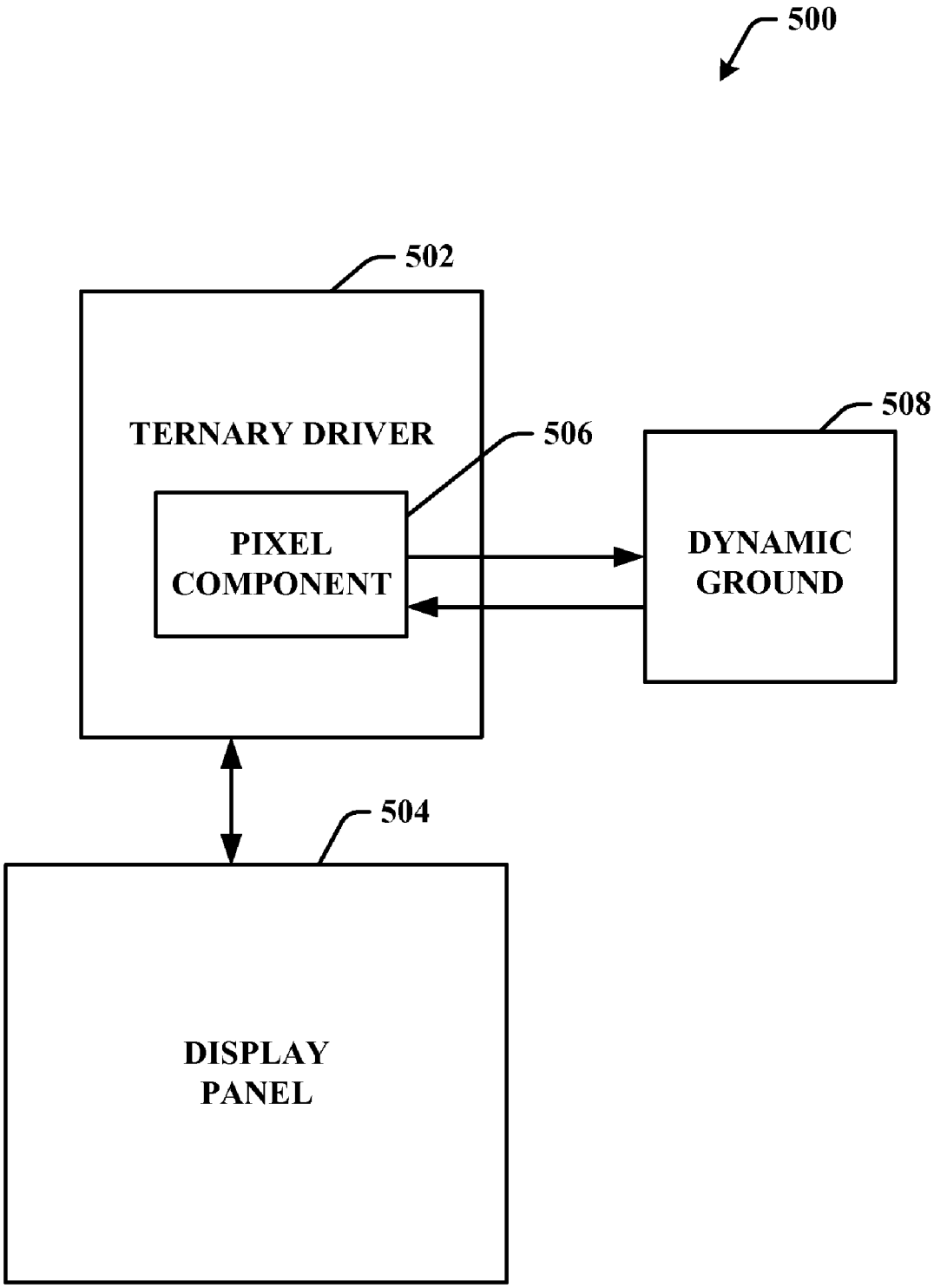
FIG. 5 illustrates a block diagram of an exemplary system that facilitates implementing a ternary driver and a dynamic ground to activate pixels on a display panel.

FIG. 5 illustrates a system 500 that facilitates activating pixels on a display panel using a ternary driver and a dynamic ground. The system 500 includes a ternary driver 502 that activates at least one pixel related to a display panel 504 providing regulated voltage levels. The ternary driver 502 can include a pixel component 506 that can provide various energized levels to the at least one pixel on the display panel 504. Moreover, the pixel component 506 can utilize a dynamic ground circuit 508 to regulate the voltage associated with the system 500. The dynamic ground circuit 508 can maintain a desired voltage of approximately zero volts when the HV transistors of the ternary driver 502 are off. When the ground voltage increases above a positive threshold or decreases below a negative threshold, the dynamic ground 508 can be activated. In one example, when activated, the dynamic ground 508 can either turn on a HV positive-channel metal oxide semiconductor (PMOS) and/or a HV negative-channel metal-oxide semiconductor (NMOS) transistor. The transistor can also remain on until the ground voltage is approximately equal to zero (e.g., including error percentages and/or a user defined deviation from zero). Utilizing this feedback approach, the ground voltage can be kept within user-defined boundaries.

In another example, the dynamic ground 508 can be created using a Schmitt Trigger that employs at least one operational amplifier (op-amp) comparator and set-reset "NAND" (logic operator) latches. The Schmitt Trigger can be activated whenever the ground node voltage becomes greater or smaller than ±1 volt. As a "divided down" voltage (e.g., divided by a factor of 100 by utilizing an attenuator with gain 0.01) rises above and/or below the ±10 mv threshold (e.g., which are used as the comparison thresholds in the comparators), the dynamic ground 508 can employ the behavior level implementation of the Schmitt Trigger.

In another example, the deviation from approximately zero volts can occur due to slow drift of the ground node due to transistor leakage currents, or due to fast "glitches" that are coupled from turning on and/or off rows and/or columns. The dynamic ground 508 can correct for the above-mentioned deviations and regulate the ground level back to be approximately zero volts. It is to be understood that the dynamic ground 508 can respond to glitches upon occurring, wherein the glitch can be handled when measured beyond a defined threshold. The dynamic ground circuit 508 can be band-limited, thereby acting as a low pass filter. The dynamic ground 508 can utilize a cut-off frequency (e.g., low pass filter behavior), wherein such cut-off can determine the glitch response.

It should be appreciated that the high voltage ternary driver 502 and the dynamic ground 508 can be used with micro-electromechanical systems (MEMS). The MEMS can be miniature devices such as valves, motors, actuators, gyroscopes, etc. Many MEMS devices can benefit from a ternary driver 502 and dynamic ground 504 by implementing the capabilities associated with three voltage levels; high positive voltage, high negative voltage and zero voltage. High voltage is inevitable and MEMS can be utilized with such high voltage by incorporating a ternary driver. In one example, high voltage ternary drivers can be utilized in miniaturized probes involving long life. The probes can employ a miniature gyroscope (MEMS), a device for measuring or maintaining orientation, which can be a spinning wheel on an axle. The probe's operating "life" can be extended further distances by driving the gyroscope with a high voltage ternary driver and dynamic ground.

Figure 6:
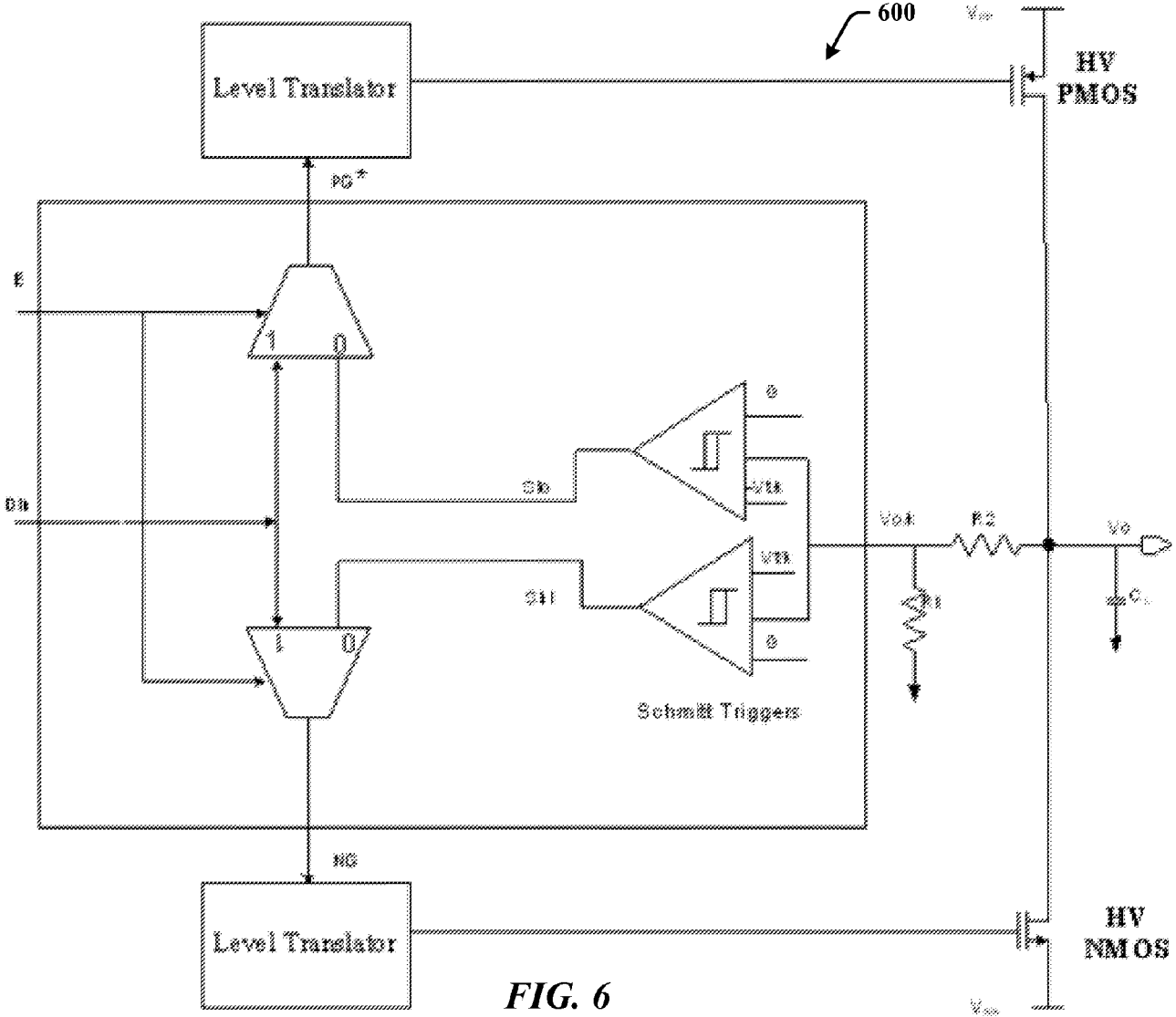
FIG. 6 illustrates the dynamic ground concept that facilitates maintaining approximately zero volts at the ground node with no static power dissipation.

FIG. 6 illustrates the concept of a dynamic ground circuit 600 diagram that facilitates maintaining approximately zero volts at the ground node. The dynamic ground circuit 600 can help to keep the desired voltage level at the ground node approximately equal to zero volts when the HV driver is off. The ground voltage can be monitored continuously and compared to threshold boundaries that define a range of permissible voltages on the ground node. If the ground voltage increases above the positive threshold or decreases below the negative threshold, the dynamic ground circuit 600 can become active. If the voltage goes outside the threshold levels either the HV PMOS or HV NMOS transistor can be turned on and remain turned on until the ground voltage is pulled up or down and can be equal to approximately 0 volts. Using this feedback approach, the ground voltage can be held within predefined bounds.

In one example, the dynamic ground can employ Schmitt Triggers that operate from ±5-V supplies and can detect ±22 mV deviations from ground, necessary to activate the high-voltage push/pull transistors that dynamically maintain ground. Various sample(s) of dynamic ground circuit diagram (s) are illustrated in Appendix B, "PolyDisplay Ideal Dynamic Ground". Appendix B provides illustrations/examples in connection with various aspects of the innovation, and this appendix is considered part of the detailed description of this application.

Figure 7:
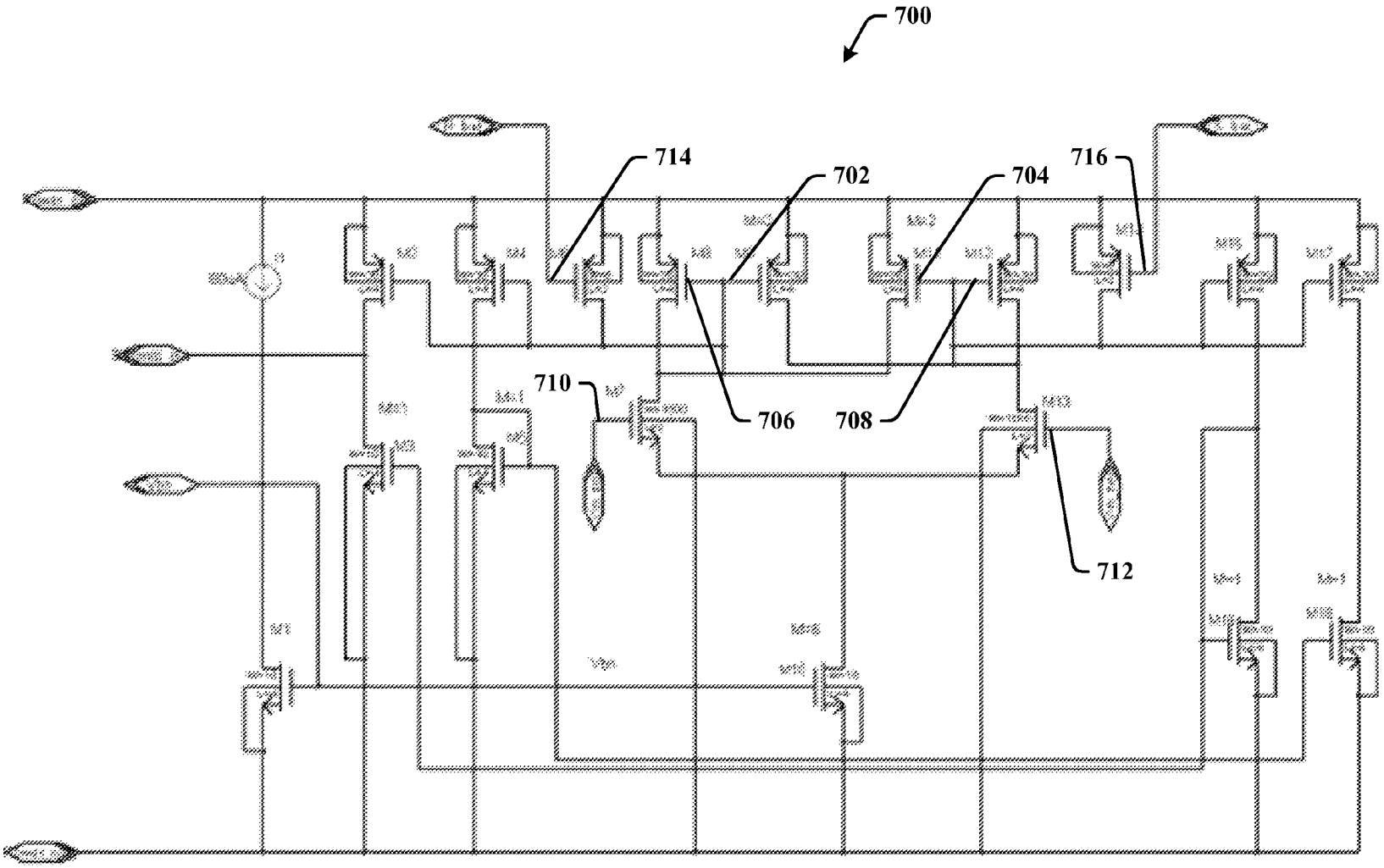
FIG. 7 illustrates a balanced Schmitt Trigger circuit schematic that facilitates maintaining a ground voltage.

FIG. 7 illustrates a balanced Schmitt Trigger 700 circuit schematic that facilitates maintaining a ground voltage. A transistor M9 702 and a transistor M11 704 can be associated with the circuit to provide electrical response, wherein a transistor M8 706 and a transistor M12 708 can be utilized to maintain the desired output levels. The circuit can also include a source coupled pair of transistors, an M7 710 and an M13 712 that can be utilized by the Schmitt Trigger to switch the state of the circuit. The Schmitt Trigger circuit can be much like a fully differential current-mirror operational amplifier (opamp) except that the transistor M9 702 and the transistor M11 704 are added to provide the necessary positive feedback. These transistors can be larger than the respective diode-connected counterparts, M8 706 and M12 708, and can act as a latching load that tends to hold the present state of the output. When the differential input voltage Vin is sufficiently reversed, however, the source-coupled pair, M7 710 and M13 712, can provide a differential current that overcomes the latching current and the state of the Schmitt Trigger is toggled.

Due to the symmetry of the circuit shown in FIG. 7, the thresholds will be substantially similar but opposite in polarity. In one example, the magnitude of the thresholds can be determined by the gate-drive bias of the source-coupled pair and the feedback factor, e.g. the ratio of transistor sizes in the load, which can be presently set to 2. This integer ratio in device sizes can be implemented accurately and efficiently and simulation can verify that it provides thresholds of ±22 mV. In order to obtain the desired unipolar behavior, in other words a low-side Schmitt Trigger with thresholds at 0 V and −22 mV and a high-side Schmitt trigger with thresholds at 0 V and +22 mV, SET/RESET transistors can be added (M6 714 and M14 716). When the gate of M14 716 is lowered, the latching load can be forced to the high state and when the gate of M6 714 is lowered, the latching load can be forced to the low state. Various sample(s) Schmitt Trigger circuit(s) are schematically illustrated in Appendix C, "Transistor Circuits for Dynamic Ground IC". Appendix C provides illustrations/examples in connection with various aspects of the innovation, and this appendix is considered part of the detailed description of this application.

Figure 7A:
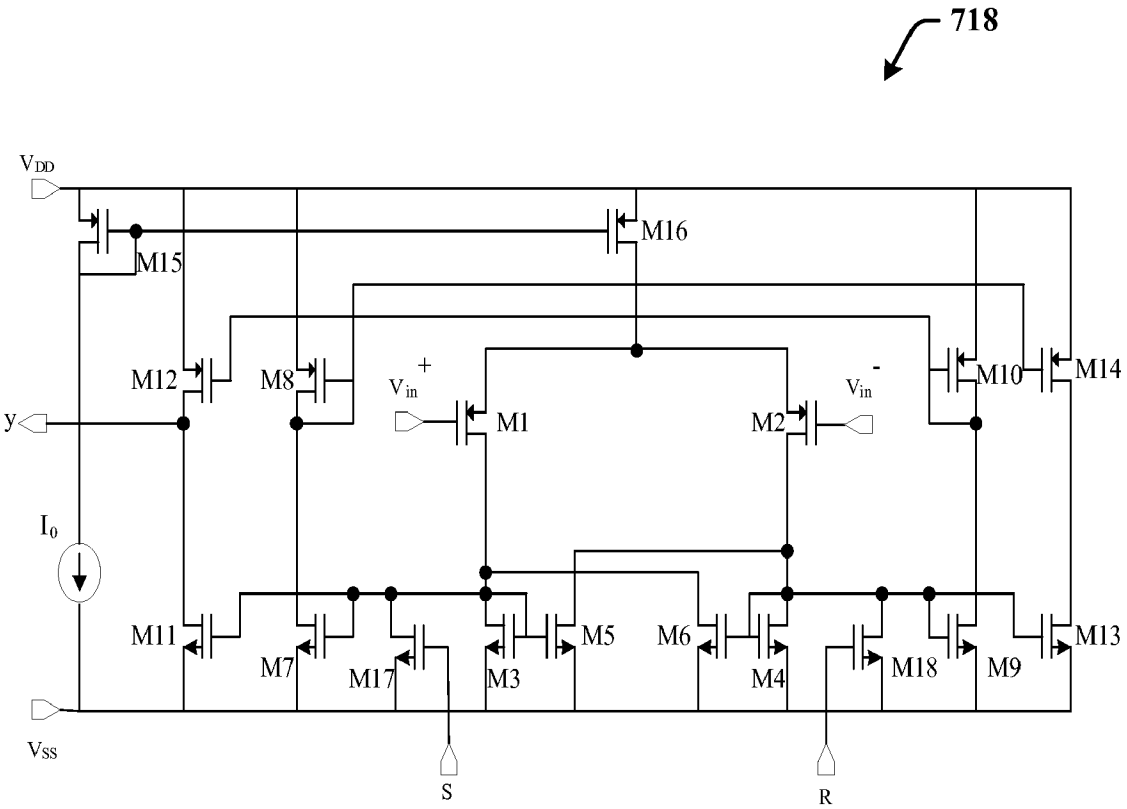
FIG. 7*a* illustrates a Schmitt Trigger circuit schematic that facilitates maintaining a ground voltage.

Turning briefly to FIG. 7*a*, a disparate Schmitt Trigger 718 is illustrated. It is to be appreciated that the Schmitt Trigger 718 can be substantially similar to the Schmitt Trigger 700. However, the polarity of the transistors in the circuit can allow operation at ground. In addition, the Schmitt Trigger 718 includes a few added transistors to enable the circuit to perform faster.

Figure 8:
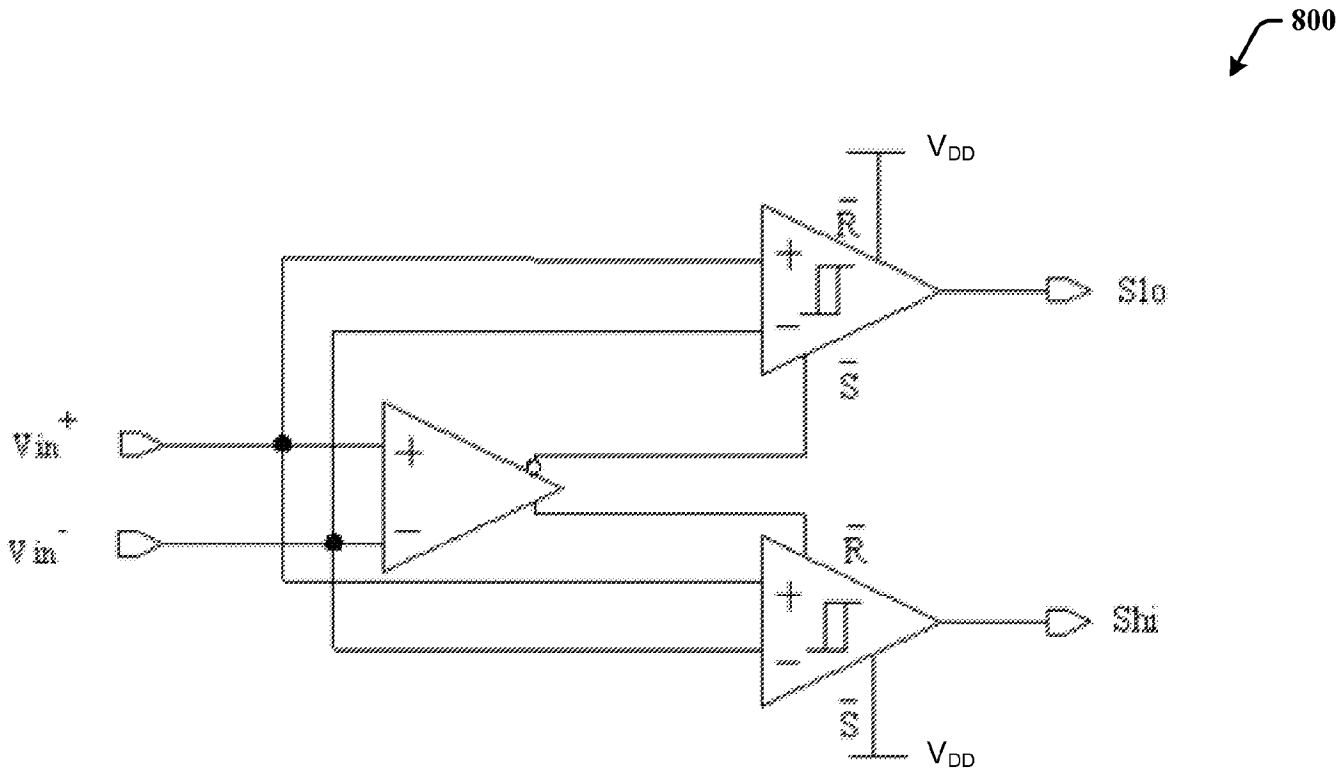
FIG. 8 illustrates a circuit schematic that facilitates low/high-side threshold detection for maintenance of dynamic ground, using two copies of the balanced Schmitt Trigger and a differential amplifier.

FIG. 8 illustrates a circuit schematic that facilitates low/high-side threshold detection 800 for maintenance of dynamic ground, using two copies of the balanced Schmitt Trigger and a differential amplifier. The circuit 800 used for low-side and high-side detection can utilize two copies of the balanced Schmitt Triggers that can be combined with a simple differential comparator used for zero detection. In one example, when the input is less than 0 V, the true output of the comparator can go low to RESET the high-side Schmitt Trigger and when the input is greater than 0 V, the complementary output of the comparator can go low to SET the low-side Schmitt Trigger. In the complete implementation of the Dynamic Ground IC, the thresholds for activation of the high-voltage push/pull drivers can be set by a voltage divider that is constructed using one on-chip resistor and one off-chip resistor per channel. With Schmitt Trigger thresholds of ±22 mV and a voltage divider ratio of 0.022, for example, the push/pull thresholds that limit the fluctuation of dynamic ground can be ±1 V. The on-chip resistors can be set to 220 kΩ, in which case the off-chip resistor would be 10 MegΩ and resistor power dissipation in the high/low states would be 1 mW/channel, assuming ±100-V high-voltage supplies. Various sample(s) of low/high-side threshold detection circuit schematic(s) are illustrated in Appendix C, "Transistor Circuits for Dynamic Ground IC".

Figure 9:
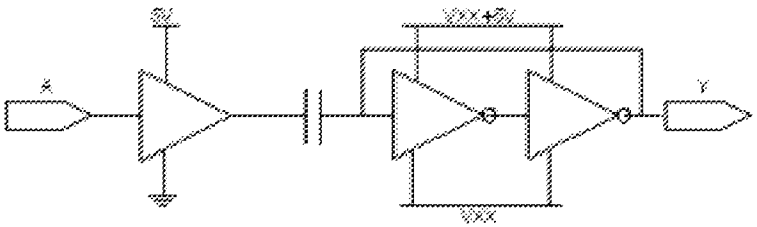
FIG. 9 illustrates a Level Translator circuit schematic that requires zero static power dissipation.

FIG. 9 illustrates a Level Translator circuit 900 schematic that requires zero static power dissipation. The circuit 900 can convert 0/5-V logic levels to a low- or high-side gate drive and can utilize a high-voltage IC process with dielectric isolation such that low- and high-side logic gates can operate using 5 V shifted to the level of the high-voltage $V_{NN}$ and $V_{PP}$ supplies, without experiencing these high voltages. In one example, the circuit 900 can operate in static CMOS fashion and carry no dc current, which can be critical to managing power dissipation in high-voltage applications. The low-side and high-side translators can be equivalent circuits and in this case, the logic can operate across 5 V, but the absolute levels can be shifted to meet the needs of the logic interface (0/5 V), the high-side drive (95/100 V), and the low-side drive (−100/−95 V).

When the circuit 900 is powered, the low/high-side latches can be in undefined states, but can be quickly forced to known states. Each time a logic input is switched from low-to-high or high-to-low, this transition can be coupled through the on-chip high-voltage coupling capacitor to the high/low-side latch, which can forced to follow, assuming that the rise/fall time of the transient, the value of the coupling capacitor, and the relative drive strengths of the logic circuits are well chosen. If the states of the logic and high/low-side circuits were initially inconsistent, the states can be made consistent upon the first transition and it can also be possible to design asymmetry into the latch circuits to insure consistent power-on states. Various sample(s) of Level Translator circuit schematic(s) are illustrated in Appendix C, "Transistor Circuits for Dynamic Ground IC".

Figure 10:
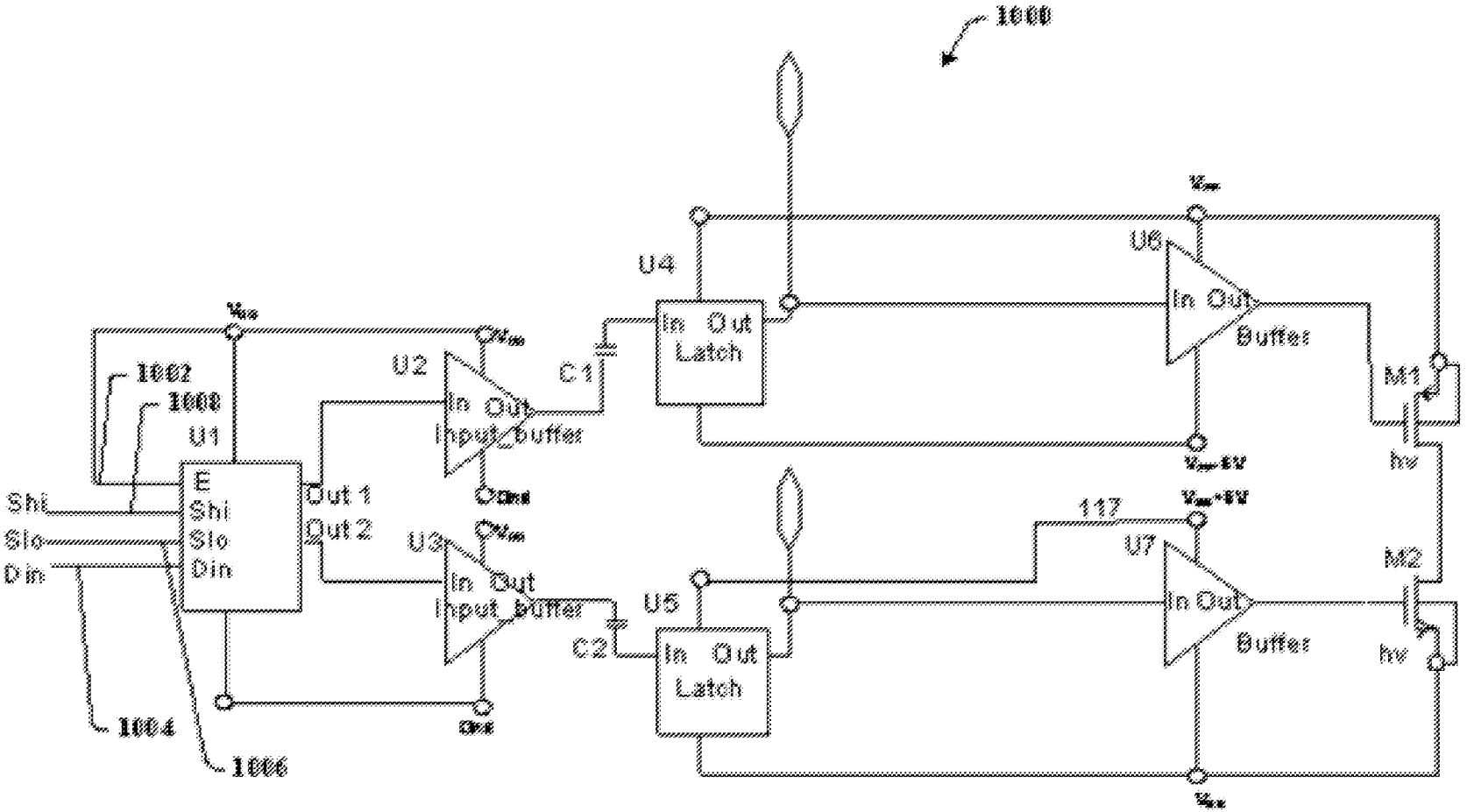
FIG. 10 illustrates a bipolar, high-voltage driver schematic with logic for dynamic ground operation disabled.

FIG. 10 illustrates a bipolar, high-voltage driver schematic 1000 with logic for dynamic ground operation disabled. An input voltage E 1002 can be associated a data input Din 1004 which can drive an output between a high output voltage $V_{PP}$ and a low output voltage $V_{NN}$ when the enable (E) input is high. When E is low, a low-side Schmitt Trigger level detector (Slo) 1006 and a high-side Schmitt Trigger level detector (Shi) 1008 can be utilized with level translators that transistors can be activated when the voltage is outside the predetermined threshold levels. Two Level Translators can be combined with control logic, low-voltage buffers, and high-voltage push/pull transistors to form the high-voltage ternary driver circuit 1000.

In one example, when the enable input E 1002 is high, the data input Din 1004 can simply be passed to the inputs of the Level Translators to drive the output in a binary, push/pull fashion, and the output can be driven between $V_{PP}$ and $V_{NN}$ as per Din 1004. When E 1002 is low, the control logic can ignore Din 1004, but unlike conventional tri-state drivers, the controls produced by the Schmitt Trigger level detectors (Slo 1006 and Shi 1008) can be passed through to the appropriate Level Translators such that the high-voltage PMOS transistor can be turned on when the detected level is below threshold, and the high-voltage NMOS transistors can be turned on when the detected level is above threshold. In other words, the low-side detector can activate the high-side drive and the high-side detector activates low-side drive. In both cases, the push/pull transistor can be turned off when the detected level is restored to 0 V, as determined by the inputs from the Schmitt Trigger level detectors. Various sample(s) of high voltage ternary driver circuit schematic(s) are illustrated in Appendix C, "Transistor Circuits for Dynamic Ground IC".

Figure 11:
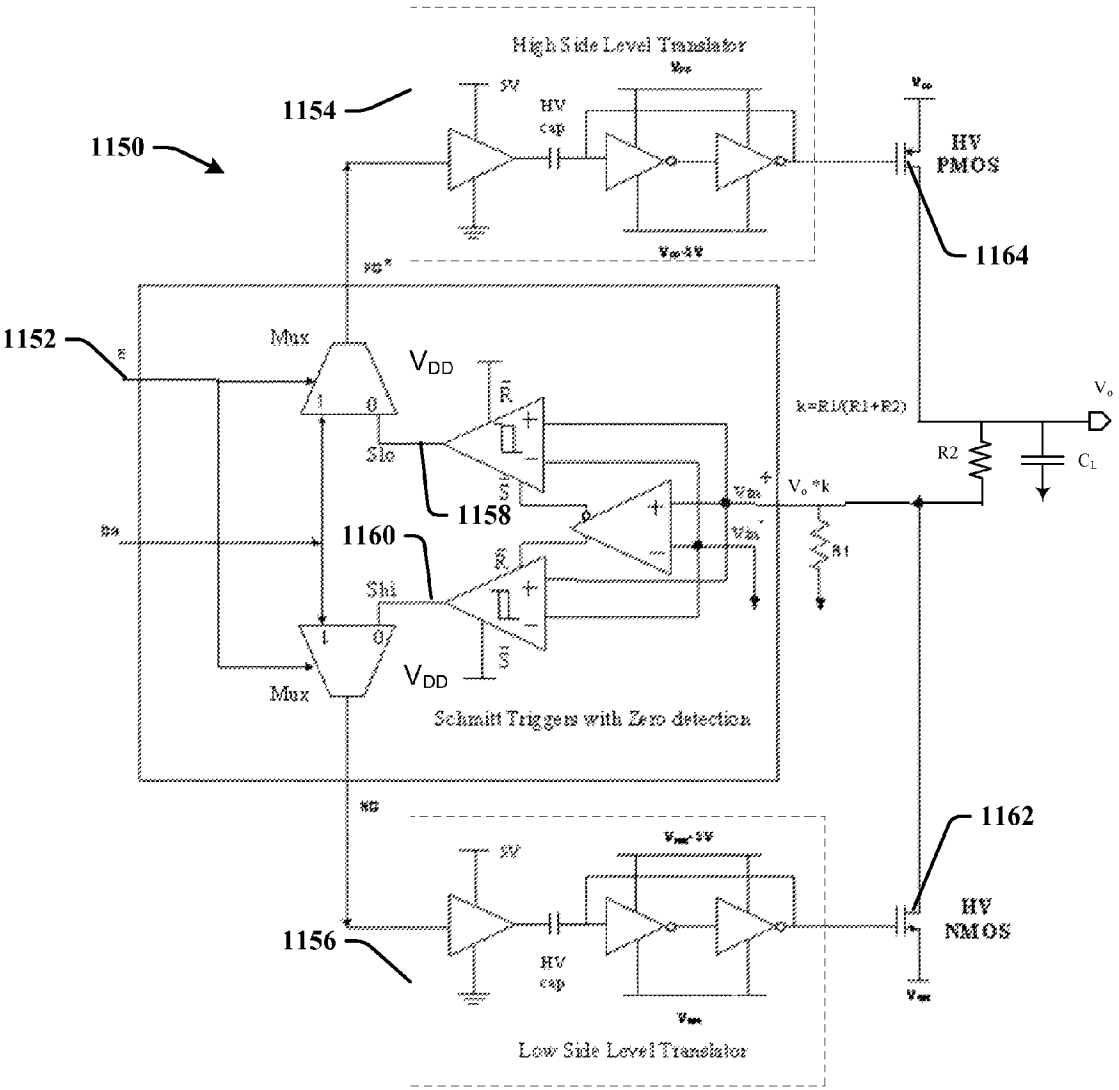
FIG. 11 illustrates the circuit schematic of a complete ternary driver based on the dynamic ground concept, utilizing low/high-side detection circuits and bipolar, high-voltage drive.

FIG. 11 illustrates the circuit schematic of a complete ternary driver circuit 1150 based on the dynamic ground concept, utilizing low/high-side detection circuits and bipolar, high-voltage drive. When enable input E 1152 is high, multiplexors are used to pass the data input Din directly to the level translators (1154 and 1156), and the circuit outputs binary, high-voltage levels. When enable input E is low, the low/high-side threshold detection outputs from the Schmitt triggers, Slo 1158 and Shi 1160, are passed through to the corresponding level translators, closing the dynamic ground feedback loops.

As discussed supra, the high-voltage ternary driver can provide three discrete output levels, +HV, ground, and −HV. In one example, this can provide significant benefits in the operation of a MEMS with regards to reliability. When Vo drifts above Vin, the HV NMOS 1162 can be turned on until Vo is pulled below 0 V. When Vo drifts below −Vin, the HV PMOS 1064 is turned on until Vo is pulled above 0 V. By utilizing this feedback approach, the ground voltage can consistently be held at and/or near zero volts. The MEMS can experience less fluctuation in voltage which can result in longer life and greater reliability.

Figure 12:
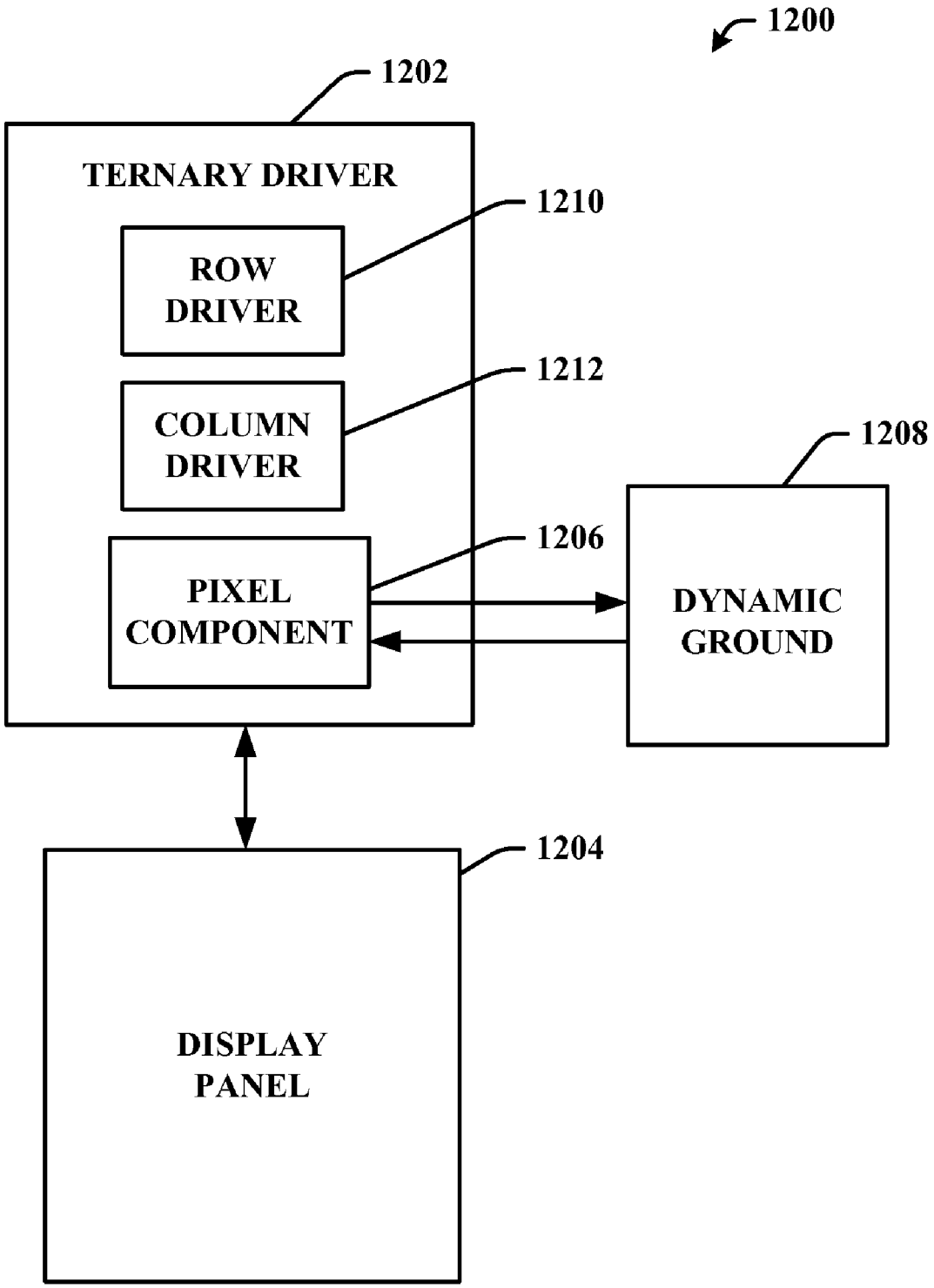
FIG. 12 illustrates a block diagram of an exemplary system that facilitates activating pixels on a display panel utilizing a row driver and a column driver.

FIG. 12 illustrates a system 1200 that facilitates activating pixels on a display panel using a row driver and column driver that both take advantage of the circuit dynamic ground. The system 1200 can include a ternary driver 1202 that can activate at least one pixel linked to a display panel 1204 that provides regulated voltage levels. The dynamic ground can monitor the pixel component 1206 voltage as the pixel component 1206 discharges and when the voltage reaches a lower level the high voltage ternary driver can recharge the pixel component 1206. The display panel 1204 can have a timing controller (not shown) that is a digital integrated circuit (IC), incorporated into the ternary driver 1202. The ternary driver 1202 also can control the display panel 1204, which influences the timing of data written into the display panel 1204 (e.g., LCD display panel, etc.). In one example, the ternary driver 1202 can reset a row driver 1210 and a column driver 1212 to start writing data at the top of the display panel 1204. The ternary driver can further scan one row at a time to the last row at the bottom of the display panel 1204. The row driver 1210 can select which row to have data written at a given time. The column driver 1212 can convert the digital video data input in the display panel 1204 into an analog voltage that can be stored across each individual pixel cell.

In another example, mobile cell phones that utilize greater LCD capable screens can utilize the system 1200. For instance, the system 1200 in conjunction with a cell phone (not shown) can provide video broadcast, complex games and camera capability. Ternary drivers 1202 can deliver these needed improvements in mobile screen applications that utilize LCD drivers, which deliver better resolution, greater battery life and higher levels of integration.

Figure 13:
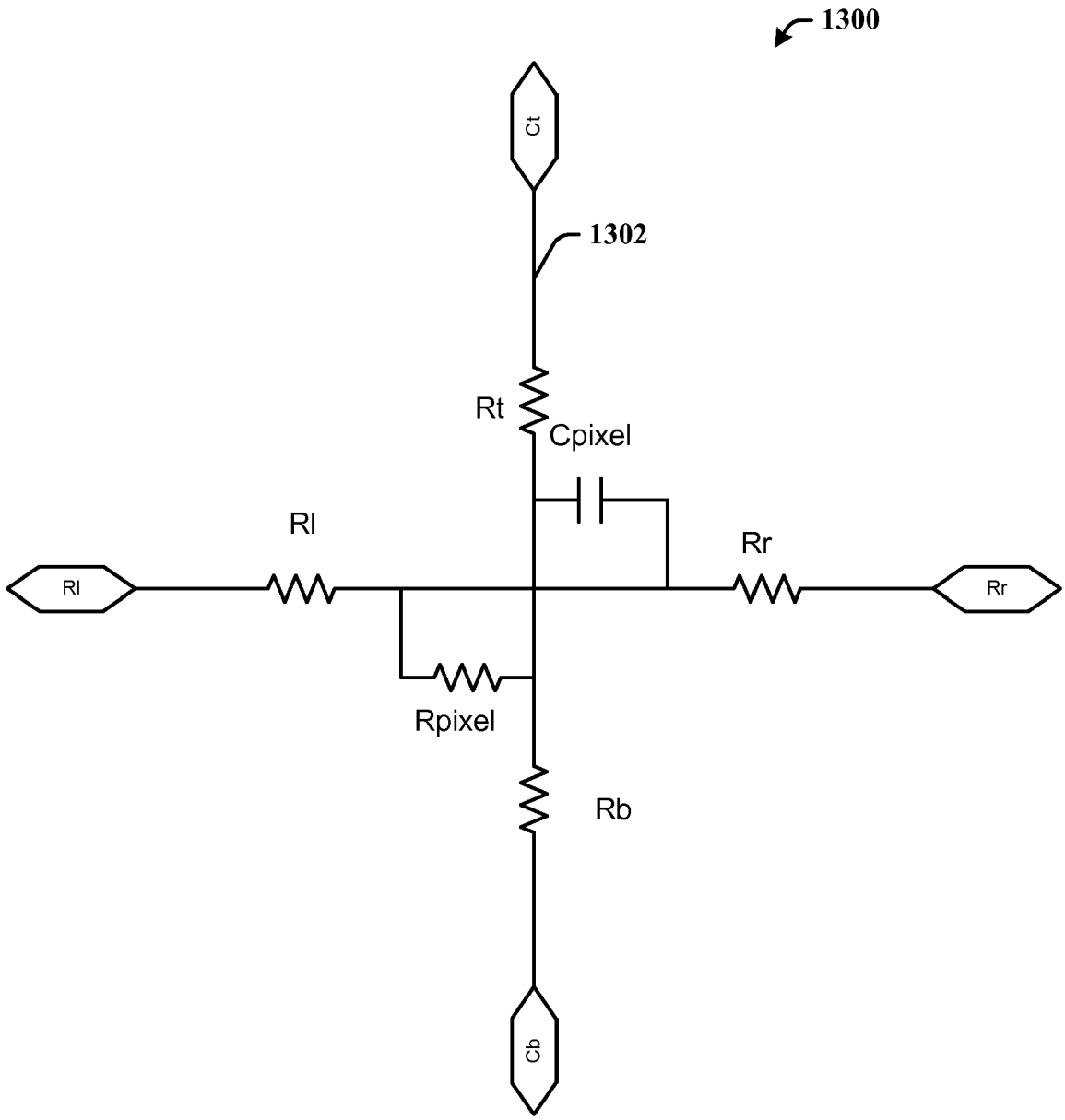
FIG. 13 illustrates an electrical model of a single pixel in accordance with the claimed subject matter.

FIG. 13 illustrates a system 1300 that utilizes an electrical model to simulate a single pixel in the panel display. Each pixel 1302 in a display panel (not shown) can be modeled as a leaky capacitor (e.g., a capacitor in parallel with a leakage conductance). At each intersection of rows and columns, the distributed row/column interconnects resistance can be modeled by dividing the resistance into two segments on either side of the pixel 1302. In one example, a parameterized model can be based on a personal computer simulation program with integrated circuit emphasis (e.g., PSpice, etc.) parameter syntax. Parameter values can be defined according to display panel data, and can be adjusted accordingly. The pixel capacitance can be defined according to the most recent panel data, for example, such as, but not limited to, 60 pF, pixel conductance as 0.3 μS, and interconnect resistance as 100Ω, or in other words, 50Ω on each side of the pixel. Various sample(s) of single pixel electrical schematics are illustrated in Appendix D, "PolyDisplay Panel Design". Appendix D provides illustrations/examples in connection with various aspects of the innovation, and this appendix is considered part of the detailed description of this application.

Figure 14:
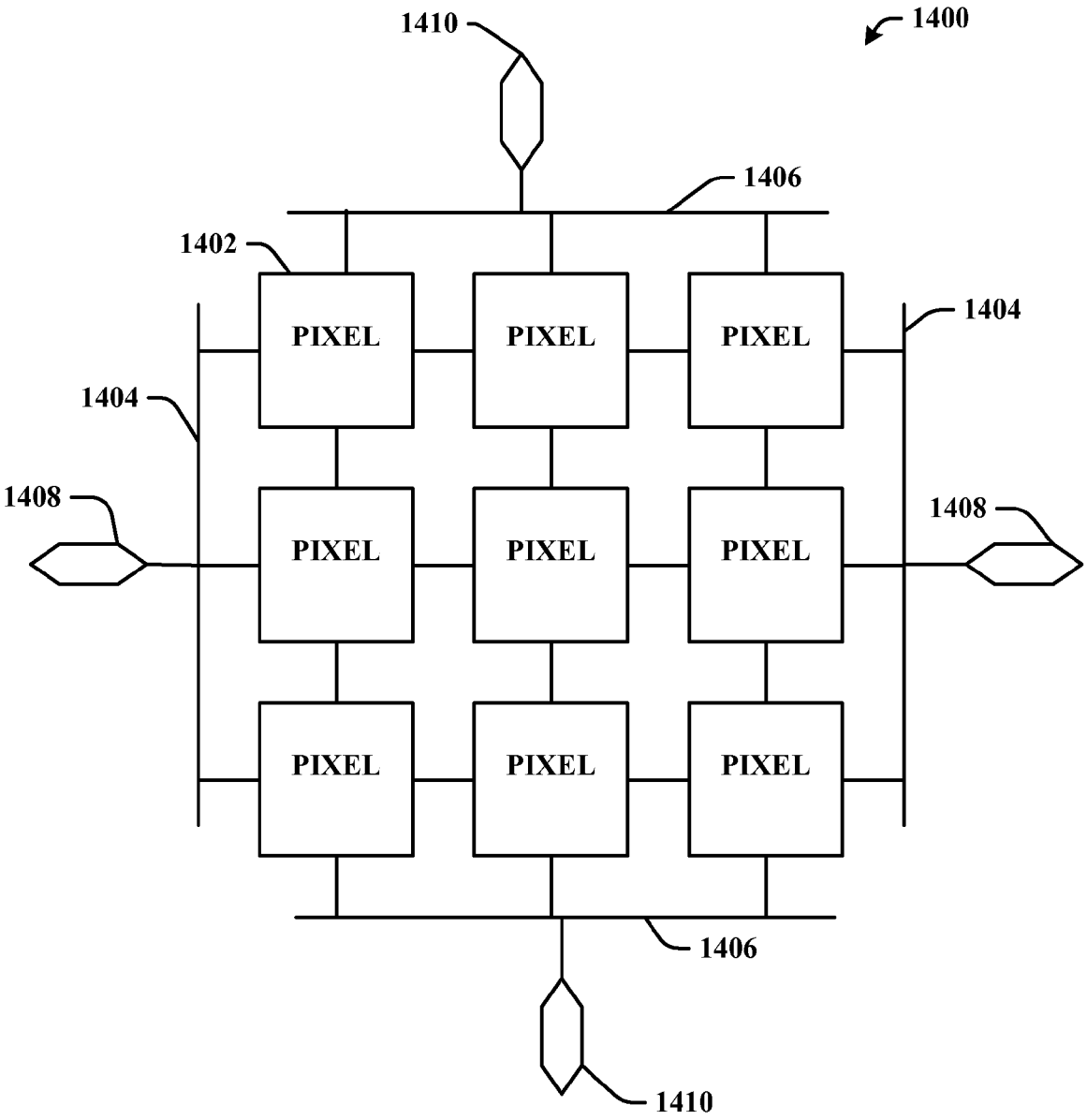
FIG. 14 illustrates a block diagram of an exemplary system of a display panel that has 3×3 or nine total pixels.

FIG. 14 illustrates a system 1400 that produces an electrical model of a display panel utilizing a 3×3 matrix of modeled pixels. The system 1400 can include a pixel 1402 linked to a row driver 1404 and a column driver 1406. Each pixel 1402 can be assembled into a matrix of nine pixels or a 3×3 cell. A test circuit can provide simulations that can consist of at least one of the following: a simulated display panel, the row driver 1404, the column driver 1406, a row termination 1408 and a column termination 1410. The row drivers 1406 and/or column drivers 1408 can be modeled using one voltage source for rows and a disparate voltage source for columns, which can be out-of-phase with each other. Each row or column can be selectively connected to the row and/or column voltage source or ground via a small resistor.

In one example, an LCD display panel (not shown) can include a bank of capacitors, each representing the pixel 1402 in the LCD display panel. The capacitors can accumulate different levels of charge depending on the amount of illumination utilized per the pixel 1402. When a picture is displayed on the display panel, a scan of at least a portion of the pixel 1402 capacitors can be performed, allocating different levels of charge on each capacitor in order to generate the image. It is to be appreciated that the process of updating the display can be referred to as "scanning" and once scanned, an image can be retained with pixel 1402 capacitance and a controller (not shown) and source line drivers (not shown) can be placed on a low power mode. Over time, these pixel 1402 charges can leak and the capacitors may have to be recharged by the row drivers 1406 and column drivers 1408 to maintain the image. The dynamic ground can monitor the pixel 1402 voltage as the pixel 1402 discharges and when the voltage reaches a lower level the high voltage ternary driver can recharge the pixel 1402. It should be appreciated that the base-3 numbering is for illustration purposes only and the pixel matrix can be any size, including a single pixel. Various sample(s) of 3×3 pixel electrical model(s) are shown in Appendix D, "PolyDisplay Panel Design".

Figure 15:
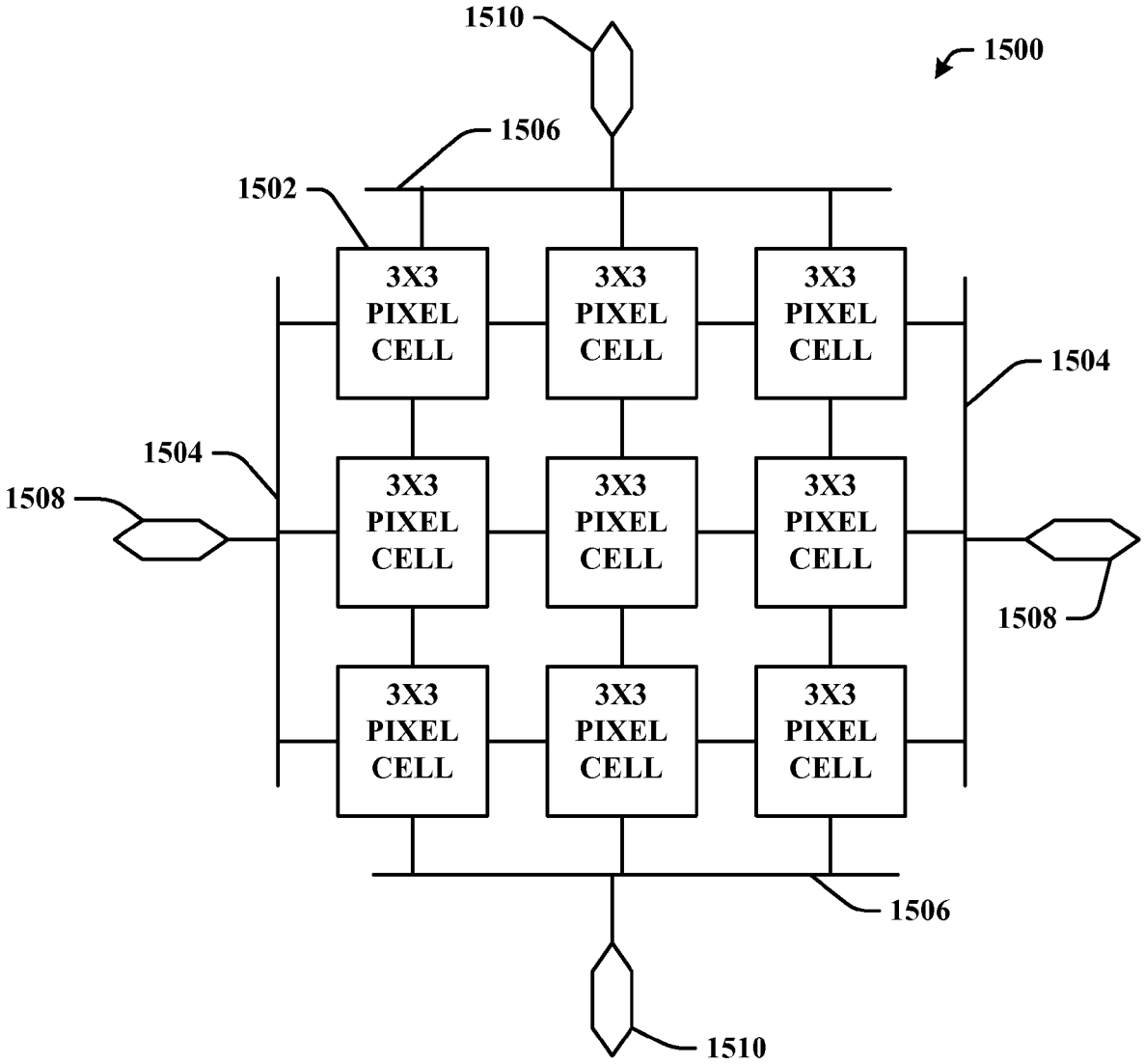
FIG. 15 illustrates a block diagram of an exemplary system of a display panel using 9×9 or eighty-one total pixels in accordance with at least one aspect of the claimed subject matter.

FIG. 15 illustrates a system 1500 that creates an electrical model of a display panel utilizing a 9×9 matrix of pixels. The system 1500 can include a row driver 1504 and a column driver 1506 that can activate at least a 3×3 pixel cell 1502. In one example, the 3×3 pixel cell 1502, can be considered a subassembly, and assembled into a matrix of 3 rows by 3 columns of the 3×3 pixel cells 1502, creating eighty-one pixels or a 9×9 cell. Simulations can again be conducted using a test circuit consisting of simulated display panel, row drivers 1504, column drivers 1506, a row termination 1508 and a column termination 1510. The row drivers 1504 and/or column drivers 1506 are actually modeled using one voltage source for rows and one for columns, which are out-of-phase with each other. Each row or column can be selectively connected to the row and/or column voltage source or ground via a very small resistor, which can allow display panels to be built up from the subassemblies.

In another example, the rows and columns can be driven in an arbitrary manner to mimic realistic conditions of the display panel and the simulation can be used to verify the more efficient operation of a ternary driver (not shown) and a dynamic ground (not shown) when compared to the binary driver. The system 1500 can adjust the capacitance, leakage and interconnect resistance between 3×3 pixel cells 1502. It is to be appreciated that the 3×3 and 9×9 matrices are for illustration purposes only and the pixel matrix can be any size, including a single pixel. Various sample(s) of 9×9 pixel matrices are illustrated in Appendix D, "PolyDisplay Panel Design."

Figure 16:
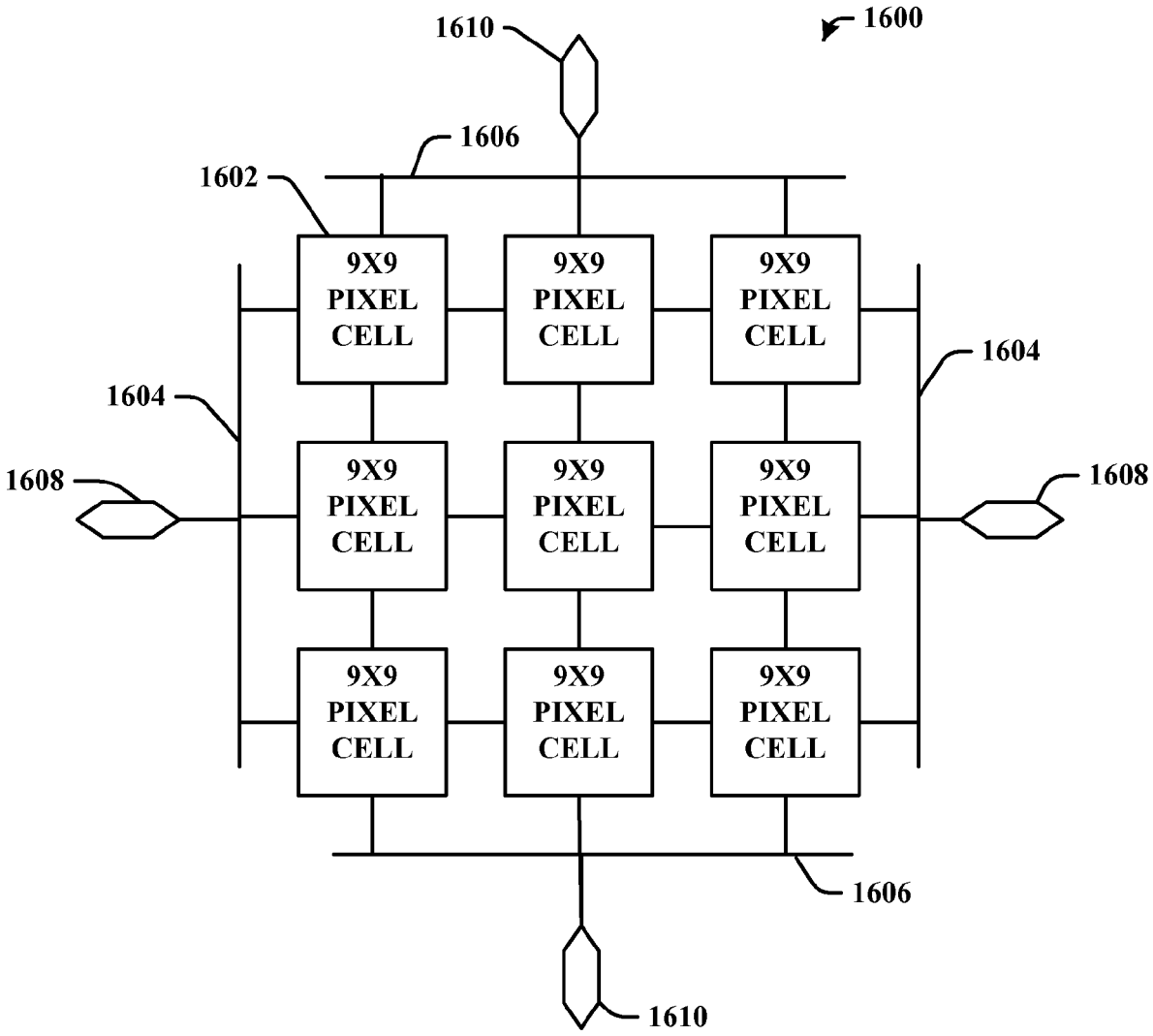
FIG. 16 illustrates a block diagram of an exemplary system of a display panel using 27×27 or seven hundred and twenty nine total pixels in accordance with the claimed subject matter.

FIG. 16 illustrates a system 1600 that generates an electrical model of a display panel utilizing a 27×27 matrix of pixels. The system 1600 can include a row driver 1604 and a column driver 1606 that can activate at least one pixel matrix utilizing a row termination 1608 and a column termination 1610. In one example, the model can be constructed by hierarchically assembling the 27×27 cell using nine 9×9 cells. Furthermore, the rows and columns can be numbered from 0 to 26, with pixel 1602; "0, 0" being depicted at the top-left of the matrix. In one specific example, the specific pixels can be identified by names in a format such as, but not limited to, "Upanel.Uax.Uby.Ucz," where coordinates a, b, c, d, e, and f are modulo-3 integers that identify the row-column coordinate of each cell in the hierarchy. Coordinate "ax" identifies the 9*9 cell, coordinate "by" identifies the 3*3 cell, and coordinate "cz" identifies the pixel. The variables a, b, and c can be thought of as being the base-3 number that identifies the row number of the pixel, and x, y, and z as the base-3 number that identifies the column number of the pixel 1602. It should be appreciated that the 27×27 matrix is for illustration purposes only and the pixel matrix can be any size, including a single pixel.

Electronic simulations conducted using the system 1600 can model the ternary drive approach where row drivers 1604 and column drivers 1606 are driving the rows and/or columns out of phase using waveforms that switch between negative voltage (−HV/2) and positive voltage (+HV/2). An undriven row or column can be held at approximately zero (0) volts by the dynamic ground. The ternary driver can allow the FAP to receive an AC voltage with approximately uniform amplitude of HV, while the HAP will receive approximately steady AC voltage having an amplitude of HV/2and thus the ternary driver can reduce the excessive power dissipation that is associated with HAPs in a binary system. Various samples(s) of electrical pixel matrix model(s) are shown in Appendix D, "PolyDisplay Panel Design."

Figure 17:
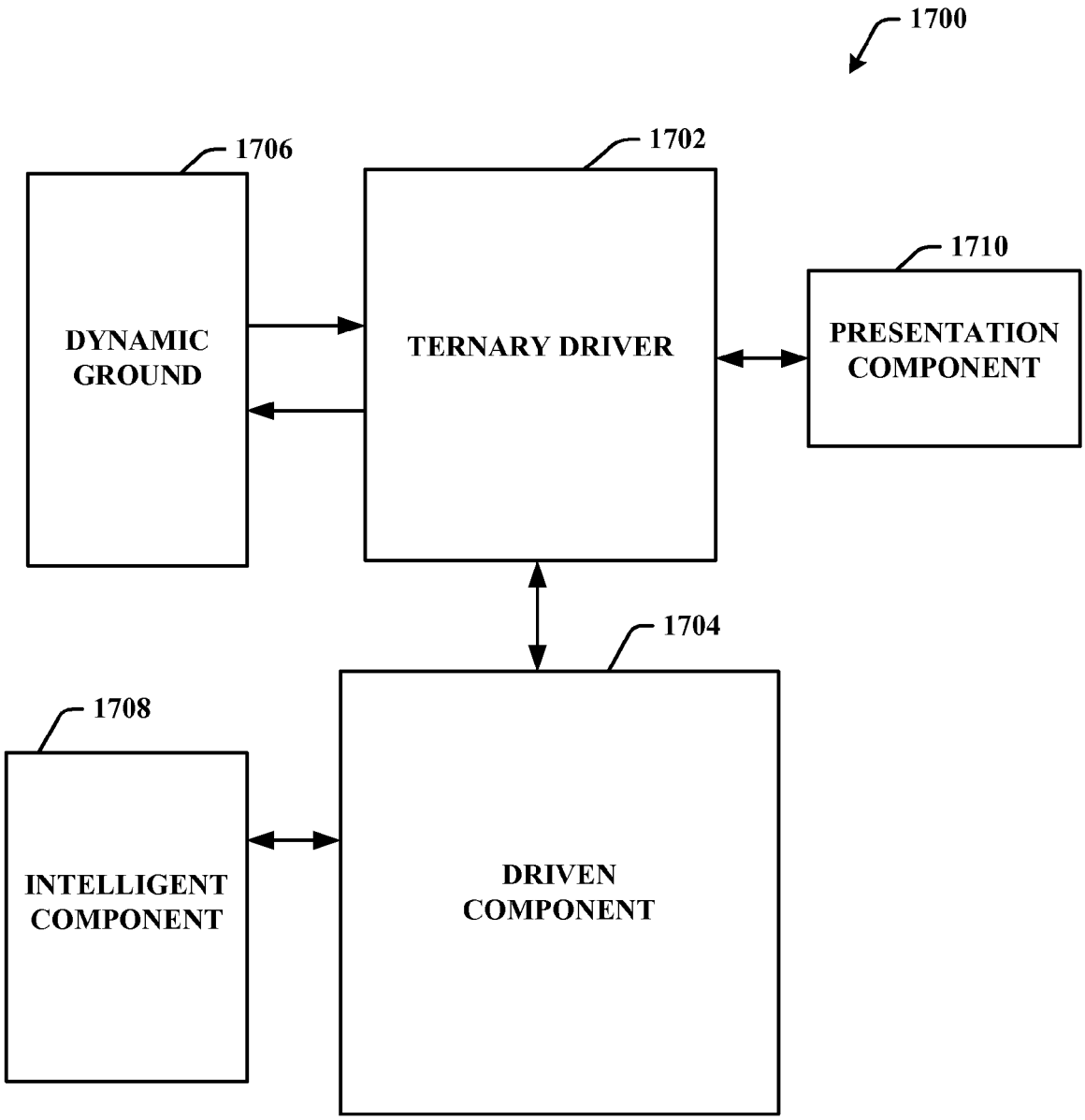
FIG. 17 illustrates a block diagram of an exemplary system that facilitates activating a driven component utilizing intelligence.

FIG. 17 illustrates a system 1700 that employs inference technology to facilitate the use of a ternary driver that interacts with a dynamic ground monitoring a driven component 1704. The system 1700 can include a ternary driver 1702, a driven component 1704 and a dynamic ground 1706 that can all be substantially similar to respective components, drivers, panels, and grounds described in previous figures. It should be appreciated that the driven component 1704 can also be used with a micro-electromechanical systems (MEMS), a display panel, etc. It is also to be appreciated that a plurality of ternary drivers 1702 can be utilized with a plurality of driven components 1704. The system 1700 further includes an intelligent component 1708 that can be used with a presentation component 1710 allowing the user to interface with the ternary driver 1702 and the dynamic ground 1706. The intelligent component 1708 can be used in a process allowing the driven component 1704 to exclusively receive messages associated with the dynamic ground 1706. For example, the intelligent component 1708 can infer the reference voltages of the dynamic ground 1706 to the driven component 1704, the deterioration of health associated with the dynamic ground 1704, switching a deteriorated process with a healthy process (e.g., such that the healthy process is bound with a receive location), etc.

In another example, the user interfacing with the presentation component 1710 and the intelligent component 1708 can set the reference voltages for the dynamic ground 1706 to maintain approximately zero volts. The high voltage ternary driver 1702 can utilize the dynamic ground 1706 to drive an implanted MEMS device for analysis. In particular, MEMS device can be utilized to analyze blood, tissue, cells, etc. in a human. These implantable devices can provide quicker analytical response than traditional techniques. The ternary system can provide significant power consumption advantages over a binary driver, as discussed earlier.

It is to be understood that the intelligent component 1708 can provide for reasoning about or infer states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several events and data sources. Various classification (explicitly and/or implicitly trained) schemes and/or systems (e.g., support vector machines, neural networks, expert systems, Bayesian belief networks, fuzzy logic, data fusion engines . . . ) can be employed in connection with performing automatic and/or inferred action in connection with the claimed subject matter.

A classifier is a function that maps an input attribute vector, x=(x1, x2, x3, x4, xn), to a confidence that the input belongs to a class, that is, f(x)=confidence(class). Such classification can employ a probabilistic and/or statistical-based analysis (e.g., factoring into the analysis utilities and costs) to predict or infer an action that a user desires to be automatically performed. Other directed and undirected model classification approaches include, e.g., naïve Bayes, Bayesian networks, decision trees, neural networks, fuzzy logic models, and probabilistic classification models providing different patterns of independence, which can be employed. Classification as used herein also is inclusive of statistical regression that can be utilized to develop models of priority.

The presentation component 1710 can provide various types of user interfaces to facilitate interaction between a user and any component coupled to the ternary driver 1702. As depicted, the presentation component 1710 is a separate entity that can be utilized with the ternary driver 1702. However, it is to be appreciated that the presentation component 1710 and/or similar view components can be incorporated into the ternary driver 1702 and/or a stand-alone unit. The presentation component 1710 can provide one or more graphical user interfaces (GUIs), command line interfaces, and the like. For example, a GUI can be rendered that provides a user with a region or means to load, import, read, etc., data, and can include a region to present the results of such. These regions can comprise known text and/or graphic regions comprising dialogue boxes, static controls, drop-down-menus, list boxes, pop-up menus, as edit controls, combo boxes, radio buttons, check boxes, push buttons, and graphic boxes. In addition, utilities can be employed to facilitate the presentation such vertical and/or horizontal scroll bars for navigation and toolbar buttons to determine whether a region is capable of being viewed. For example, the user can interact with one or more of the components coupled to the ternary driver 1702.

The user can also interact with the regions to select and provide information via various devices such as a mouse, a roller ball, a keypad, a keyboard, a pen and/or voice activation. Typically, a mechanism such as a push button or the enter key on the keyboard can be employed subsequent to entering the information, in order to initiate the search. However, the claimed subject matter is not so limited. For example, merely highlighting a check box can initiate information conveyance. In another example, a command line interface can be employed. For example, the command line interface can prompt (e.g., via a text message on a display and an audio tone) the user for information via providing a text message, consequently the user can than provide suitable information, such as alpha-numeric input corresponding to an option provided in the interface prompt or answer a question posed in the prompt. It is to be appreciated that the command line interface can be employed in connection with a GUI and/or API. In addition, the command line interface can be employed in connection with hardware (e.g., video cards) and/or displays (e.g., black and white, and EGA) with limited graphic support, and/or low bandwidth communication channels.

Figure 18:
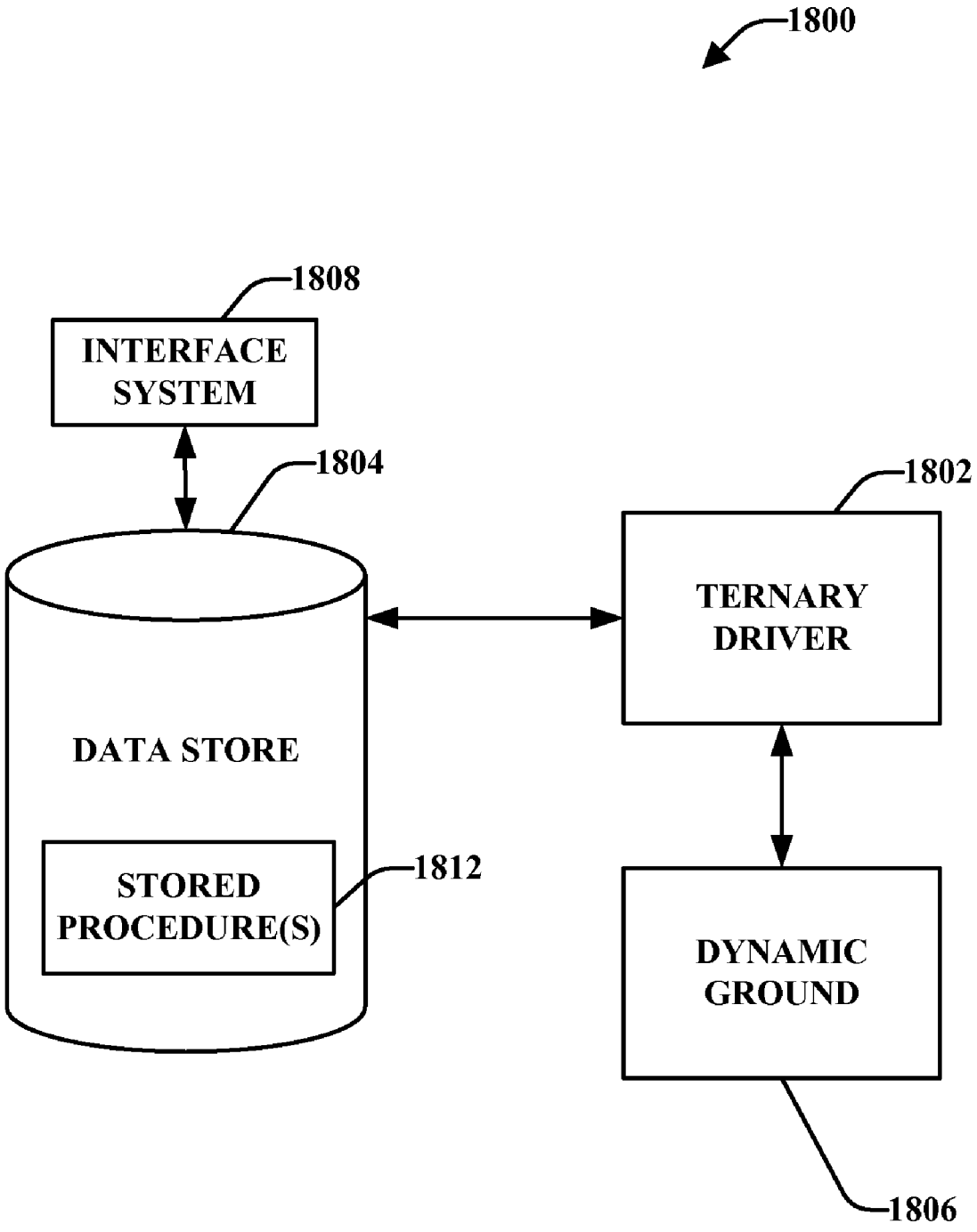
FIG. 18 illustrates a block diagram of an exemplary system that facilitates storing data related to the high voltage ternary driver and the dynamic ground.

FIG. 18 illustrates a system 1800 that employs a data store to facilitate storing data related to the high voltage ternary driver and dynamic ground. A ternary driver 1802 can utilize a data store 1804, wherein the data store 1804 can store various data related to a dynamic ground 1806 and the system 1800, such as the dynamic ground 1806 voltage history, user defined reference voltages, ternary driver 1802 activation times and ternary drive 1802 voltage history, etc. The data store 1804 can be, for example, either volatile memory or nonvolatile memory, or can include both volatile and nonvolatile memory.

By way of illustration, and not limitation, nonvolatile memory can include read only memory (ROM), programmable ROM (PROM), electrically programmable ROM (EPROM), electrically erasable programmable ROM (EEPROM), or flash memory. Volatile memory can include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM). The data store 1804 of the subject systems and methods is intended to comprise, without being limited to, these and any other suitable types of memory. In addition, it is to be appreciated that the data store 1804 can be a server, a database, a hard drive, and the like. The user can interface with the system 1800 by way of an interface system 1808 which allows the user to set reference voltages which can activate the dynamic ground 1806.

Figure 19:
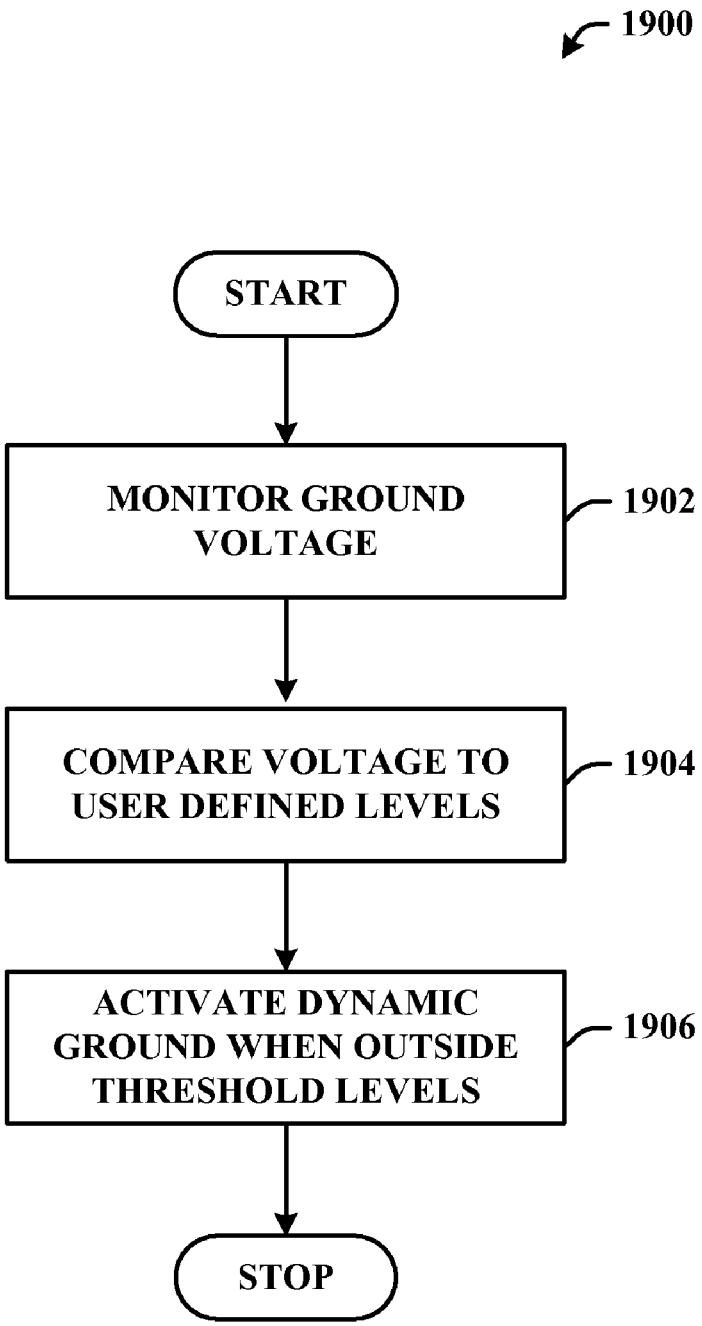
FIG. 19 illustrates a methodology for utilizing the dynamic ground with threshold ground level voltage to activate at least one pixel.

FIG. 19 illustrates a methodology 1900 for controlling the ground voltage in a ternary driver. At 1902, the ground voltage can be monitored to determine if the voltage is outside a user defined reference voltages levels. It is appreciated and understood that the voltage can be monitored frequently at given and/or variable time intervals. At 1904, the ground voltage is being monitored and compared to user defined level, such as greater than and/or less than ±1 volt. If the voltage exceeds the established parameters, the dynamic ground is activated, which can turn on the HV PMOS and/or NMOS transistor to reestablish a voltage of approximately zero. The voltage can be frequently compared via employing the threshold boundaries that define a range of permissible voltages on the ground node. Further, if the ground voltage increases above the positive threshold level and/or decreases below the negative threshold level, the dynamic ground circuit can become active. It is to be appreciated that the end user can modify the positive and negative threshold levels.

At 1906, the dynamic ground circuit is activated if the ground voltage increases above the positive defined voltage level and/or below the negative defined voltage level. Further, the dynamic ground circuit can be activated where the HV PMOS transistor and/or the HV NMOS transistor (e.g., push/pull transistors) are turned on and remain on until the ground voltage is pulled up or pulled down reaching the desired level of zero volts. For instance, level translators can provide the necessary gate drive for the push-pull transistors without consuming DC power from the high-voltage supplies.

Figure 20:
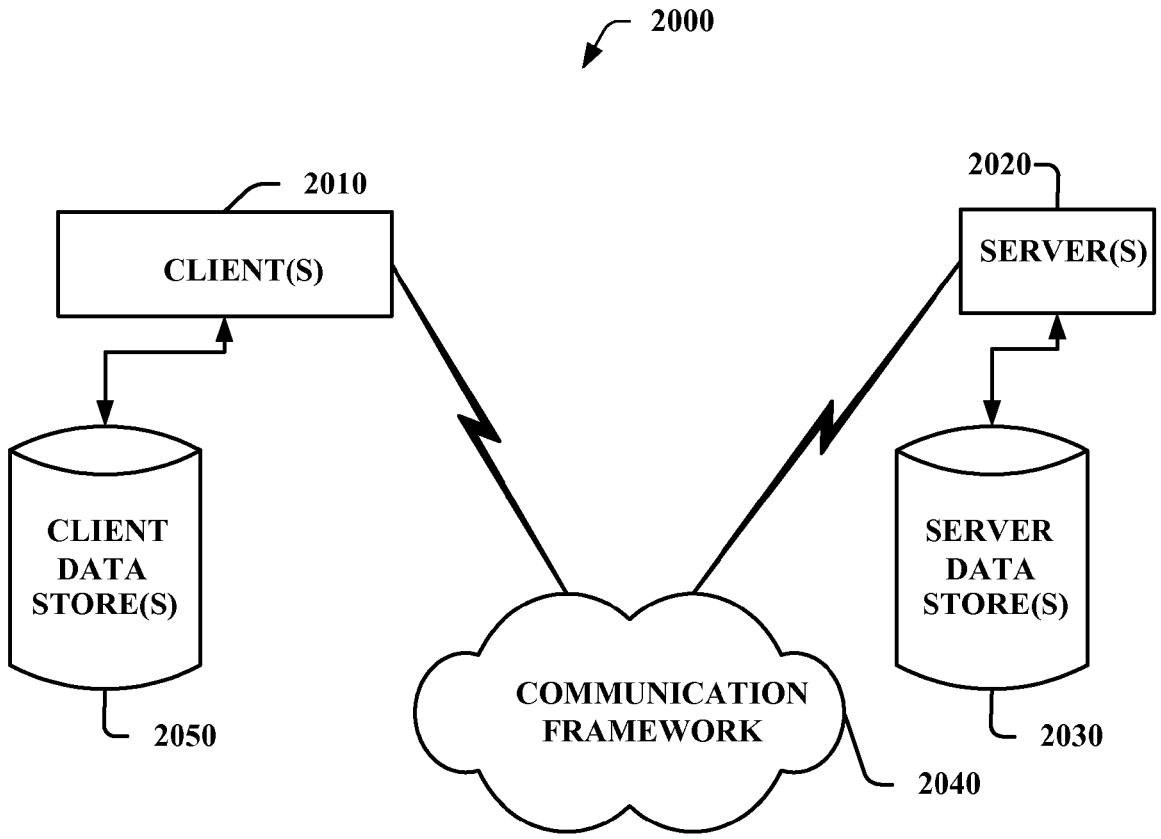
FIG. 20 illustrates an exemplary networking environment, wherein the novel aspects of the claimed subject matter can be employed.
Figure 21:
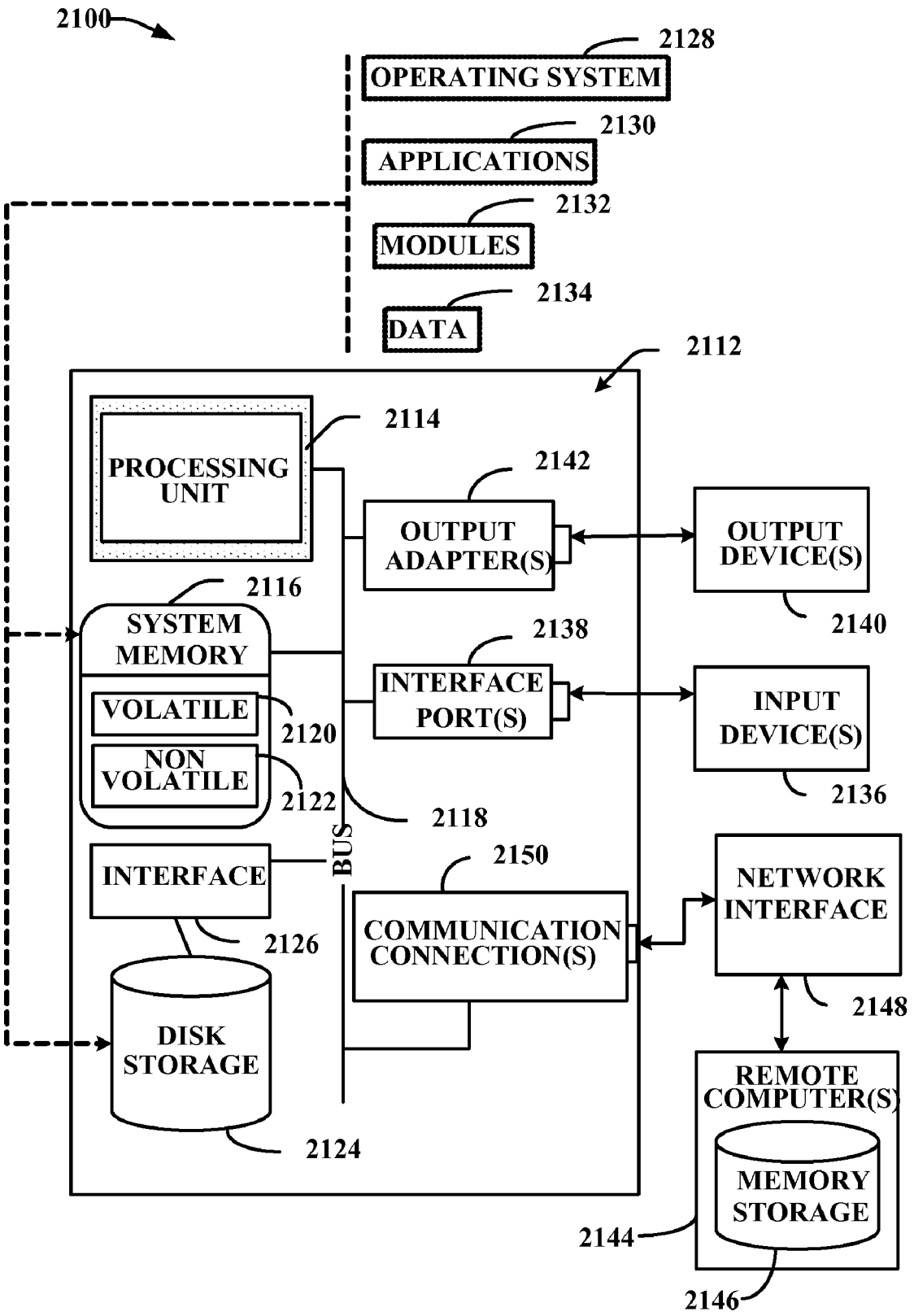
FIG. 21 illustrates an exemplary operating environment that can be employed in accordance with the claimed subject matter.

In order to provide additional context for implementing various aspects of the claimed subject matter, FIGS. 20-21 and the following discussion is intended to provide a brief, general description of a suitable computing environment in which the various aspects of the subject innovation may be implemented. While the claimed subject matter has been described above in the general context of computer-executable instructions of a computer program that runs on a local computer and/or remote computer, those skilled in the art will recognize that the subject innovation also may be implemented in combination with other program modules. Generally, program modules include routines, programs, components, data structures, etc., that perform particular tasks and/or implement particular abstract data types.

Moreover, those skilled in the art will appreciate that the inventive methods may be practiced with other computer system configurations, including single-processor or multiprocessor computer systems, minicomputers, mainframe computers, as well as personal computers, hand-held computing devices, microprocessor-based and/or programmable consumer electronics, and the like, each of which may operatively communicate with one or more associated devices. The illustrated aspects of the claimed subject matter may also be practiced in distributed computing environments where certain tasks are performed by remote processing devices that are linked through a communications network. However, some, if not all, aspects of the subject innovation may be practiced on stand-alone computers. In a distributed computing environment, program modules may be located in local and/or remote memory storage devices.

FIG. 20 is a schematic block diagram of a sample-computing environment 2000 with which the claimed subject matter can interact. The system 2000 includes one or more client(s) 2010. The client(s) 2010 can be hardware and/or software (e.g., threads, processes, computing devices). The system 2000 also includes one or more server(s) 2020. The server(s) 2020 can be hardware and/or software (e.g., threads, processes, computing devices) and can house threads to perform transformations by employing the subject innovation, for example.

One possible communication between a client 2010 and a server 2020 can be in the form of a data packet which can be adapted to transmit between two or more computer processes. The system 2000 includes a communication framework 2040 that can be employed to facilitate communications between the client 2010 and the server(s) 2020. The client(s) 2010 are operably connected to one or more client data store(s) 2050 that can be employed to store information local to the client(s) server 2010. Similarly, the server(s) 2020 are operably connected to one or more server data store(s) 2030 that can be employed to store information local to the servers 2020.

With reference to FIG. 21, an exemplary environment 2100 for implementing various aspects of the claimed subject matter includes a computer 2112. The computer 2112 includes a processing unit 2114, a system memory 2116, and a system bus 2118. The system bus 2118 couples system components including, but not limited to, the system memory 2116 to the processing unit 2114. The processing unit 2114 can be any of various available processors. Dual microprocessors and other multiprocessor architectures also can be employed as the processing unit 2114.

The system bus 2118 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 2116 includes volatile memory 2120 and nonvolatile memory 2122. The basic input/output system (BIOS), containing the basic routines to transfer information between elements within the computer 2112, such as during start-up, is stored in nonvolatile memory 2122. By way of illustration, and not limitation, nonvolatile memory 2122 can include read only memory (ROM), programmable ROM (PROM), electrically programmable ROM (EPROM), electrically erasable programmable ROM (EEPROM), or flash memory. Volatile memory 2120 includes random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 2112 also includes removable/non-removable, volatile/non-volatile computer storage media. FIG. 21 illustrates, for example a disk storage 2124. Disk storage 2124 includes, but is not limited to, devices like a magnetic disk drive, floppy disk drive, tape drive, Jaz drive, Zip drive, LS-100 drive, flash memory card, or memory stick. In addition, disk storage 2124 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 2124 to the system bus 2118, a removable or non-removable interface is typically used such as interface 2126.

It is to be appreciated that FIG. 21 describes software that acts as an intermediary between users and the basic computer resources described in the suitable operating environment 2100. Such software includes an operating system 2128. Operating system 2128, which can be stored on disk storage 2124, acts to control and allocate resources of the computer system 2112. System applications 2130 take advantage of the management of resources by operating system 2128 through program modules 2132 and program data 2134 stored either in system memory 2116 or on disk storage 2124. It is to be appreciated that the claimed subject matter can be implemented with various operating systems or combinations of operating systems.

A user enters commands or information into the computer 2112 through input device(s) 2136. Input devices 2136 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 2114 through the system bus 2118 via interface port(s) 2138. Interface port(s) 2138 include, for example, a serial port, a parallel port, a game port, and a universal serial bus (USB). Output device(s) 2140 use some of the same type of ports as input device(s) 2136. Thus, for example, a USB port may be used to provide input to computer 2112 and to output information from computer 2112 to an output device 2140. Output adapter 2142 is provided to illustrate that there are some output devices 2140 like monitors, speakers, and printers, among other output devices 2140, which utilize special adapters. The output adapters 2142 include, by way of illustration and not limitation, video and sound cards that provide a means of connection between the output device 2140 and the system bus 2118. It should be noted that other devices and/or systems of devices provide both input and output capabilities such as remote computer(s) 2144.

Computer 2112 can operate in a networked environment using logical connections to one or more remote computers, such as remote computer(s) 2144. The remote computer(s) 2144 can be a personal computer, a server, a router, a network PC, a workstation, a microprocessor based appliance, a peer device or other common network node and the like, and typically includes many or all of the elements described relative to computer 2112. For purposes of brevity, only a memory storage device 2146 is illustrated with remote computer(s) 2144. Remote computer(s) 2144 is logically connected to computer 2112 through a network interface 2148 and then physically connected via communication connection 2150. Network interface 2148 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 2150 refers to the hardware/software employed to connect the network interface 2148 to the bus 2118. While communication connection 2150 is shown for illustrative clarity inside computer 2112, it can also be external to computer 2112. The hardware/software necessary for connection to the network interface 2148 includes, for exemplary purposes only, internal and external technologies such as, modems including regular telephone grade modems, cable modems and DSL modems, ISDN adapters, and Ethernet cards.

What has been described above includes various exemplary aspects. It is, of course, not possible to describe every conceivable combination of components or methodologies for purposes of describing these aspects, but one of ordinary skill in the art may recognize that many further combinations and permutations are possible. Accordingly, the aspects described herein are intended to embrace all such alterations, modifications and variations that fall within the spirit and scope of the appended claims.

Appendices A, B, C, D, E, F, G, H, and I provide illustrations/examples in connection with various aspects of the innovation, and these appendices are considered part of the detailed description of this application.

Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method for providing a discrete output signal, the method comprising:

providing an enable signal having a logic state that is indicative of operation in one of a binary mode and a dynamic ground mode;

in the binary mode:

providing a positive voltage as the discrete output signal via a high-side transistor in response to a first state of an input signal, and providing a negative voltage as the discrete output signal via a low-side transistor in response to a second state of the input signal;

in the dynamic ground mode:

providing a ground voltage as the discrete output signal;

comparing a magnitude of the ground voltage to a pair of thresholds; and maintaining a magnitude of the ground voltage to within the pair of thresholds based on the comparison.

2. The method of claim 1, further comprising storing a magnitude of the pair of thresholds in a programmable memory.

3. The method of claim 1, wherein comparing the magnitude of the ground voltage to the pair of thresholds comprises comparing the magnitude of the ground voltage to a positive threshold voltage and to a negative threshold voltage.

4. The method of claim 3, wherein maintaining the magnitude of the ground-voltage comprises:

activating the PMOS transistor in response to the magnitude of the ground voltage decreasing to less than the negative threshold voltage; and activating the NMOS transistor in response to the magnitude of the ground voltage exceeding the positive threshold voltage.

5. The method of claim 1, wherein comparing the magnitude comprises:

providing the ground voltage to a first input of each of a first Schmitt Trigger and a second Schmitt Trigger;

providing a first one of the pair of thresholds to a second input of the first Schmitt Trigger and a second one of the pair of thresholds to a second input of the second Schmitt Trigger; and generating at least one output signal associated with the first and second Schmitt Triggers that is indicative of whether the ground voltage is outside of a range defined by the pair of thresholds.

6. The method of claim 5, further comprising:

providing the at least one output signal to a first multiplexer configured to provide one of the output signal and the input signal to a high-side level translator that is connected to bias the PMOS transistor; and providing the at least one output signal to a second multiplexer configured to selectively provide one of the output signal and the input signal to a low-side level translator that is connected to bias the NMOS transistor.

7. The method of claim 6, further comprising:

providing the enable signal to the first and second multiplexers to provide one of the at least one output signal and the input signal to the high-side and low-side level translators for controlling the respective PMOS and NMOS transistors based on the enable signal indicating one of the first mode and the second mode.

8. The method of claim 1, further comprising:

translating a magnitude of a first state of the input signal to approximately the positive voltage and for translating a magnitude of the second state of the input signal to a magnitude that is less than the positive voltage by less than a difference between the positive voltage and the ground voltage in the first state of the input voltage to bias the PMOS transistor; and translating the magnitude of the first state of the input signal to approximately the negative voltage and for translating the magnitude of the second state of the input signal to a magnitude that is greater than the negative voltage by a magnitude that is less than a difference between the ground voltage and the negative voltage in the second state of the input voltage to bias the NMOS transistor.

9. A system comprising:

a ternary driver that provides a discrete output signal in one of three discrete levels that varies between a high positive voltage, a high negative voltage, and a ground voltage, the ternary driver controlling the magnitude of the discrete output signal to one of the three discrete levels in response to at least one input signal; and a dynamic ground component that compares the ground voltage to at least one threshold and employs feedback to maintain the ground voltage at approximately zero volts based at least in part upon the comparison, wherein the threshold comprises a user defined positive threshold and a user defined negative threshold, the dynamic ground component being configured to maintain the ground voltage between the user defined positive and negative thresholds.

10. The system of claim 9, wherein the dynamic ground component comprises a first Schmitt trigger configured to activate a PMOS transistor upon the ground voltage decreasing less than the user defined negative threshold and a second Schmitt trigger configured to activate an NMOS transistor upon the ground voltage exceeding the user defined positive threshold.

11. A system comprising:

a ternary driver that provides a discrete output signal in one of three discrete levels that varies between a high positive voltage, a high negative voltage, and a ground voltage, the ternary driver controlling the magnitude of the discrete output signal to one of the three discrete levels in response to at least one input signal; and a dynamic ground component that compares the ground voltage to at least one threshold and employs feedback to maintain the ground voltage at approximately zero volts based at least in part upon the comparison;

wherein the input signal comprises an enable signal and a digital input voltage, the system further comprising:

a PMOS transistor interconnecting the positive voltage and an output of the ternary driver, the PMOS transistor being activated to provide the positive voltage as the discrete output signal in response to a first state of the enable signal and a first state of the digital input voltage; and an NMOS transistor interconnecting the output of the ternary driver and the negative voltage, the NMOS transistor being activated to provide the negative voltage as the discrete output signal in response to the first state of the enable signal and a second state of the digital input voltage;

wherein the ternary driver is configured to provide the ground voltage in response to a second state of the enable signal.

12. The system of claim 11, wherein the threshold comprises a positive threshold and a negative threshold, and wherein the dynamic ground component is configured to activate the PMOS transistor in response to the ground voltage decreasing to less than the user defined negative threshold and to activate the NMOS transistor in response to the ground voltage exceeding the positive threshold.

13. The system of claim 11, further comprising:

a high-side level translator configured to bias the PMOS transistor at approximately the positive voltage in response to the second state of the input voltage and at a magnitude that is less than the positive voltage by a magnitude that is less than a difference between the positive voltage and the ground voltage in response to the first state of the digital input voltage; and a low-side level translator configured to bias the NMOS transistor at approximately the negative voltage in response to the first state of the input voltage and at a magnitude that is greater than the negative voltage by a magnitude that is less than a difference between the ground voltage and the negative voltage in response to the second state of the digital input voltage.

14. A system comprising:

mode control circuitry configured to switch between a binary mode and a dynamic ground mode;

a ternary driver that provides a discrete output signal at one of three levels corresponding to a positive voltage and a negative voltage, when in the binary mode, and a ground voltage when in the dynamic ground mode, the ternary driver comprising:

a high-side level translator configured to translate a magnitude of an input signal to a high-side gate drive signal;

a PMOS transistor configured to provide the discrete output signal at the positive voltage in response to the high-side gate drive signal;

a low-side level translator configured to translate the magnitude of the input signal to a low-side gate drive signal; and an NMOS transistor configured to provide the discrete output signal at the negative voltage in response to the low-side gate drive signal; and a dynamic ground component that compares the ground voltage to a positive threshold and a negative threshold and is activated to maintain the ground voltage at approximately zero volts based on the comparison in the dynamic ground mode.

15. The system of claim 14, wherein, in the dynamic ground mode, the dynamic ground component is configured to activate the NMOS transistor in response to the ground voltage exceeding the positive threshold and to activate the PMOS transistor in response to the ground voltage decreasing less than the negative threshold.

16. The system of claim 14, further comprising a display system comprising a plurality of pixels, the discrete output signal being provided to activate at least one pixel of the display system.

* * * * *